US005236814A

United States Patent [19]

Kuse et al.

[11] Patent Number: 5,236,814

[45] Date of Patent: Aug. 17, 1993

[54] PROCESSING OF SILVER HALIDE COLOR PHOTOGRAPHIC LIGHT-SENSITIVE MATERIAL

[75] Inventors: Satoru Kuse, Hino; Shigeharu Koboshi, Sagamihara, both of Japan

[73] Assignee: Konica Corporation, Tokyo, Japan

[21] Appl. No.: 757,275

[22] Filed: Sep. 10, 1991

[30] Foreign Application Priority Data

Sep. 12, 1990 [JP] Japan ..... 2-242262

[51] Int. Cl.[5] ..... G03C 7/42

[52] U.S. Cl. ..... 430/393; 430/430; 430/455; 430/460; 430/461; 430/486; 430/490

[58] Field of Search ..... 430/393, 430, 455, 460, 430/486, 490, 461

[56] References Cited

U.S. PATENT DOCUMENTS

| | | | |
|---|---|---|---|
| 4,268,618 | 5/1981 | Hashimura | 430/393 |
| 4,948,713 | 8/1990 | Kobayashi et al. | 430/486 |
| 4,963,474 | 10/1990 | Fujita et al. | 430/393 |
| 5,066,571 | 11/1991 | Yoshida et al. | 430/486 |

FOREIGN PATENT DOCUMENTS 0308706 2/1988 European Pat. Off. .

*Primary Examiner*—Hoa Van Le

*Attorney, Agent, or Firm*—Finnegan, Henderson, Farabow, Garrett & Dunner

[57] ABSTRACT

A method for processing a silver halide color photographic light-sensitive material comprising a support having thereon a silver halide emulsion layer, comprising steps of developing said light-sensitive material with a color developer bleaching, after said developing step, said light-sensitive material with a bleaching solution, and treating, after said bleaching step, said light-sensitive material with a solution having fixing capability, wherein said light-sensitive material has a coating weight of silver of not more than 1 g/m$^2$; and said bleacher comprises at least one of ferric complex salts of compounds represented by the following formula [A] and at least one of compounds represented by the following formula [B]:

Formula [A]

$A\text{-}(COOM)_n$.

Formula [B]

9 Claims, No Drawings

PROCESSING OF SILVER HALIDE COLOR PHOTOGRAPHIC LIGHT-SENSITIVE MATERIAL

FIELD OF THE INVENTION

The present invention relates to a method of processing a silver halide color photographic light-sensitive material, more specifically, to a method of processing a silver halide color photographic light-sensitive material which effectively prevents the sludging of silver and the occurrence of bleach fogging, and allows processing to be performed rapidly without affecting adversely work environments due to the use of a bleacher having no offensive odor.

BACKGROUND OF THE INVENTION

Generally, light-sensitive materials that have been exposed to light are then subjected to processing that comprises color developing, desilvering, and rinsing and stabilizing.

Today, processing of light-sensitive materials is normally performed by photo processing shops. In such shops, processing is conducted continuously by means of automatic developing machines. To satisfy users' increasing demands for more prompt service, these photo processing shops have to complete processing and return films to their customers within a half day; that is, if they receive an order in the morning, they have to hand over a processed film in the evening of the same day. Lately, these shops are often requested to finish the work within only a couple of hours after the receipt of an order. Under such circumstances, the need of a more improved technique for rapid processing is pressing.

Meanwhile, Eastman Kodak has proposed Process RA-1, a novel method of processing color paper. It comprises three steps; 45-sec color developing, 45-sec bleach/fixing and 90-sec stabilizing. According to Process RA-1, the total processing time is three minutes, and the processing temperature is 35° C.

Conventional methods for rapid processing can be divided into the following three categories:

(1) making improvements on light-sensitive materials so that they can be more suited to rapid processing;

(2) making improvements on instruments and means employed for processing; and (3) making improvements on the compositions of processing liquids Methods relating to (1) above include:

1. improving silver halide composition, such as reducing the sizes of silver halide grains [see Japanese Patent Open to Putlic Inspection (hereinafter abbreviated as Japanese Patent O.P.I. Publication) No. 77223/1976)] or reducing the amount of silver bromide;

2. using additives, such as adding 1-aryl-3-pyrazolidone with a specific structure to a light-sensitive material (see Japanese Patent O.P.I. Publication No. 64339/1981) or adding 1-arylpyrazolidone to a light-sensitive material (Japanese Patent O.P.I. Publication Nos. 144547/1982, 50534/1983, 0535/1983 and 50536/1983):

3. using quick-reacting couplers, such as a quick-reacting yellow coupler (see Japanese Patent Examined Publication No. 10783/1976, Japanese Patent O.P.I. Publication Nos. 123342/1975 and 102636/1976); and 4. reducing the thicknesses of photographic layers (see Japanese Patent Application Specification No. 204992/1985)

As for (2), Japanese Patent Application Specification No. 23334/1986 discloses an improved method of stirring processing liquids.

Methods belonging to the category (3) include:

1. using development accelerators;

2. increasing the concentration of a developing agent in a developer; and 3. decreasing the concentration of halide ions, in particular, that of bromide ions Among various conventional methods for rapid processing, including those mentioned above, especially effective is the use of a light-sensitive material with a higher silver chloride content (see Japanese Patent O.P.I. Publication Nos. 95345/1983, 19140/1985 and 95736/1983). Such light-sensitive materials have recently put on the market (e.g. Ektacolor paper 2001 by Eastman Kodak Company, Konicacolor QA paper by Konica Co.).

Meanwhile, in recent years, to reduce processing costs as well as to prevent environmental pollution, desilvering has come to be conducted by using a bleacher and a fixer separately. This tendency is more pronounced in large-scale processing laboratories which have to reduce production costs and are under strict restrictions for pollution control. The use of a bleacher, however, involves various problems.

It is generally known that, if a low-silver light-sensitive material having a reflective support, such as color negative paper (hereinafter referred to as color paper), is treated in a bleacher immediately after color development, stains are formed on the surface of the light-sensitive material since a color developing agent that has been soaked into the light-sensitive material is oxidized due to the strong oxidative power of the bleacher. To avoid this problem, color paper, after color developing and before bleaching, is normally subjected to stopping and rinsing to wash away color developer components therefrom. This method is also defective, since it needs the provision of at least two processing liquid tanks between a color developer tank and a bleacher tank, which eventually results in an increase in cost. Under such circumstances, there is a strong demand for a method of processing color paper which can effectively prevent the formation of stains even when the color paper is treated in a bleacher immediately after color development.

Another serious problem is that, when color paper is treated in a bleacher, silver chlorobromide that is normally contained in color paper is reacted with a halide contained in a bleacher (e.g. ammonium bromide) to form silver-halogen complexes, which complexes are dissolved in the bleacher, while being diluted partially with a color developer brought into the bleacher tank by the color paper, and then precipitates in the bleacher tank to form sludge. The sludge causes clogging of a filter and other parts of an automatic processing machine, and makes it unable to work. This trouble occurs more frequently when only a small amount of a replenisher is used for a bleacher.

Still another problem accompanying the use of a bleacher is the harmful effect of a bleacher to work environments. For use, a bleacher has to be made acidic to maintain its high oxidation potential, and acetic acid is commonly used as a pH controller. Acetic acid tends to vaporize and diffuse with an offensive odor, affecting adversely the health of people working in processing laboratories.

SUMMARY OF THE INVENTION

One object of the invention is to provide a method of processing a silver halide color photographic light-sensitive material with a reflective support, by which the formation of stains is effectively prevented even though bleaching is conducted immediately after color developing.

Another object of the invention is to provide a method of processing a silver halide color photographic light-sensitive material which effectively prevents the sludging of silver in a bleacher.

Still another object of the invention is to provide a method of processing a silver halide color photographic light-sensitive material which allows bleaching to be conducted stably for a prolonged period of time and needs only a small amount of a replenisher for a bleacher.

Further object of the invention is to provide a method of processing a silver halide color photographic light-sensitive material which ensures good working environments free from the offensive odor of acetic acid.

Other objects as well as features and advantages of the invention are apparent from the following description.

The above objects can be attained by a method of processing a silver halide color photographic light sensitive material comprising subjecting a silver halide color photographic light-sensitive material that has been exposed to light to color development to develop dye images, subjecting said light-sensitive material to bleaching with a bleacher to bleach developed silver, followed by treatment with a fixative liquid to fix the dye images, wherein the total silver coverage of said light-sensitive material before processing is not more than 1 g/m$^2$, and said bleacher contains at least a ferric complex salt of a compound represented by the following Formula [A] and a compound represented by the following Formula [B]:

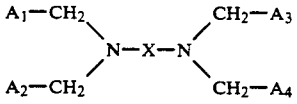

Formula [A]

[wherein $A_1$ to $A_4$, whether identical or not, each represent —$CH_2OH$, —COOM or —$PO_3M_1M_2$ (wherein M, $M_1$ and $M_2$ each represent hydrogen, sodium, potassium or ammonium); and X represents substituted or unsubstituted alkylene with 2 to 5 carbon atoms, provided that the total number of carbon atoms including those contained in its branched chains is not less than 3]

A(COOM)n Formula [B]

[wherein A represents a single bond or an n-valent group when n is 2, and represents a trivalent group when n is 3; M represents hydrogen, an alkali metal or ammonium, and when n is 2 or larger, M may be either identical or different]

DETAILED DESCRIPTION OF THE INVENTION

The method of the invention is also characterized by the use of a bleacher with a pH of 2.0 to 5.5.

Other important features of the invention are that the amount of silver chloride of grains contained in silver halide emulsion layers of a light-sensitive material to be processed by the method of the invention accounts for at least 50 mol % of the total amount of silver halide of grains contained in the emulsion layers; that a color developer employed for color developing contains a compound represented by the following Formula [A'] or [B']:

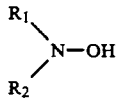

Formula [A']

[wherein $R_1$ and $R_2$, which may combine with each other to form a ring, each represent hydrogen, alkyl, aryl or

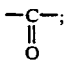

R' represents alkoxy, alkyl or aryl, provided that $R_1$ and $R_2$ cannot be hydrogen simultaneously]

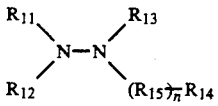

Formula [B']

[wherein $R_{11}$, $R_{12}$, and $R_{13}$ each represent hydrogen, alkyl, aryl or a heterocyclic group, each of which may be substituted; $R_{14}$ represents hydroxy, hydroxyamino, substituted or unsubstituted alkyl, substituted or unsubstituted aryl, substituted or unsubstituted heterocyclic group, alkoxy, aryloxy, carbamoyl or amino]; that the color developer contains a triazinyl stilbene-based fluorescent brightening agent represented by the following Formula [E]:

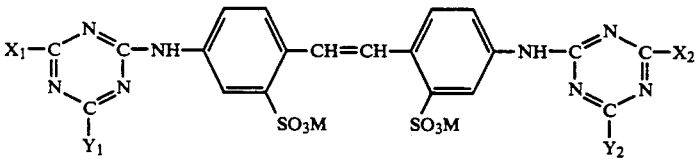

Formula [E]

[wherein $X_1$, $X_2$, $Y_1$ and $Y_2$ each represent hydroxy, halogen, alkyl, aryl,

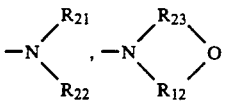

or —$OR_{25}$ (wherein $R_{21}$ and $R_{22}$ each represent hydrogen, alkyl that may have a substituent or aryl that may have a substituent; $R_{23}$ and $R_{24}$ each represent alkylene that may have a substituent; $R_{25}$ represents hydrogen, alkyl that may have a substituent or aryl that may have a substituent; and M represents a cation]; and that bleaching is conducted immediately after color developing.

An explanation will be made on the compounds represented by the Formula [A].

$A_1$ to $A_4$, whether identical or not, each represent —$CH_2OH$, —COOM or —$PO_3M_1M_2$ where M, $M_1$ and $M_2$ each represent a hydrogen atom, an alkali metal (e.g. sodium, potassium) or ammonium. X represents a substituted or unsubstituted alkylene group with 2 to 5, preferably 3 to 5, carbon atoms. Examples of such alkylene include propylene, butylene and pentamethylene. Hydroxyl and $C_{1-3}$ lower alkyl are suitable as a substituent for the alkylene.

Preferred examples of the compounds re resented by the Formula [A] are given below.

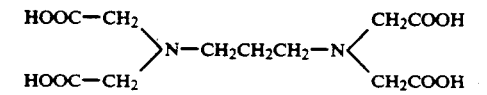
(A-1)

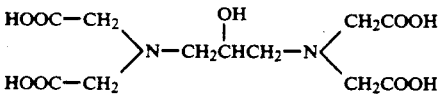
(A-2)

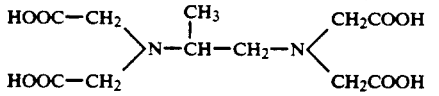
(A-3)

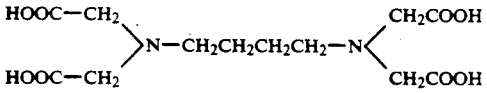
(A-4)

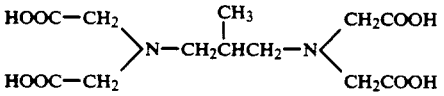
(A-5)

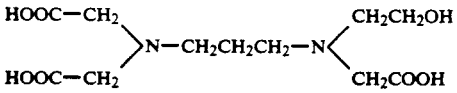
(A-6)

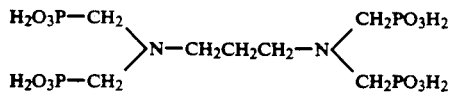
(A-7)

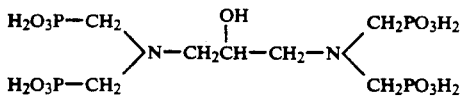
(A-8)

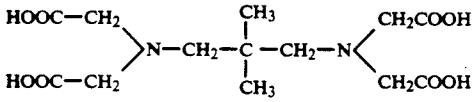
(A-9)

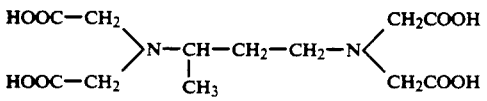
(A-10)

-continued

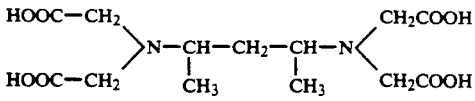
(A-11)

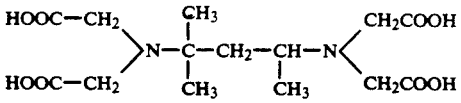
(A-12)

As the ferric complex salt of these compounds, use can be made of ferric sodium salts, ferric potassium salts or ferric ammonium salts. If the amount of an ammonium salt is too large, bleach fogging tends to occur. Therefore, the amount of an ammonium salt is preferably not more than 50 mol %, more preferably not more than 20 mol %, most preferably 0 to 10 mol %.

Of the compounds represented by the Formulae A-1 to 12, those represented by the Formulae A-1, A-4, A-7 and A-8, in particular, those represented by the Formula A-1, are preferable in the invention.

The ferric complex salts of the compounds represented by the Formula [A] are contained in the bleacher preferably in amounts of preferably 0.10 mol, more preferably 0.15 to 0.6 mol, most preferably 0.18 mol, per liter of the bleaching solution.

It is preferred that the bleaching solution of the invention contain, besides the above-mentioned ferric complex salt, a ferric complex salt of aminopolycarboxylic acid (e.g. ferric ethylenediaminetetraacetate, ferric diethylenetriaminepentaacetate, ferric 1,2-cyclohexanediaminetetraacetate, ferric glycoletherdiaminetetraacetate). However, for the successful achievement of the objects, it is preferred that substantially all of ferric complex salts contained in the bleacher be the above-mentioned ferric complex salt, i.e., the ferric complex salt of the compound represented by the Formula [A]. Here, "substantially all" means at least 70 mol %. In the invention, the amount of the ferric complex salt of the compound represented by the Formula [A] accounts for preferably not less than 80 mol %, more preferably 90 mol %, most preferably 95 mol %, of the total amount of ferric complex salts contained in the bleaching solution.

It is preferred that the bleaching solution of the invention further contain imidazole or its derivative, or at least one compound selected from those represented by the following Formulae [I] to [IX]:

Formula [I]

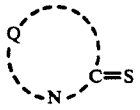

[wherein Q represents a group of metals necessary to form an nitrogen-containing heterocyclic ring (including rings formed by condensation of 5- to 6-membered saturated rings); $R_1$ represents hydrogen, alkyl with 1 to 6 carbon atoms, cycloalkyl, aryl, a heterocyclic group (including rings formed by condensation of 5- to 6-membered saturated rings) or amino]

Formula [II]

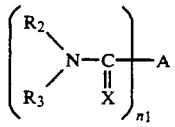

[wherein $R_2$ and $R_3$ each represent hydrogen, alkyl with 1 to 6 carbon atoms, hydroxy, carboxy, amino, acyl with 1 to 3 carbon atoms, aryl or alkenyl; A represents

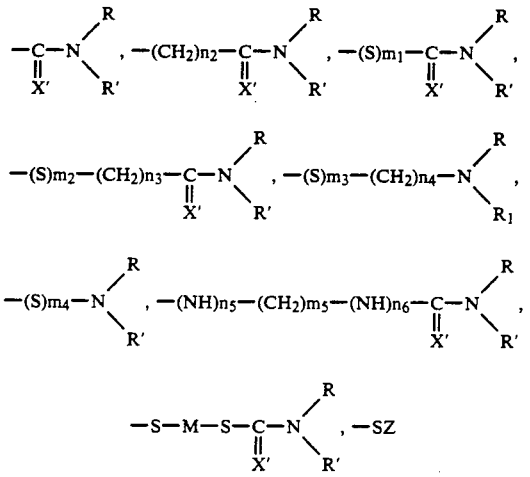

or an $n_1$-valent heterocyclic residue (including those formed by condensation of 5- to 6-membered rings); X represents =S, =O or =NR″ (where R and R′ respectively have the same meaning as $R_2$ and $R_3$); X′ has the same meaning as X; Z represents hydrogen, an alkali metal, ammonium, amino, an nitrogen-containing heterocyclic residue, alkyl or

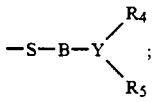

M represents a group of divalent metals; R″ represents hydrogen, alkyl with 1 to 6 carbon atoms, cycloalkyl, aryl, a heterocyclic residue (including those formed by condensation of 5- to 6-membered rings) or amino; $n_1$ to $n_6$ and $m_1$ to $m_5$ each represent an integer of 1 to 6; B represents alkylene with 1 to 6 carbon atoms; Y represents

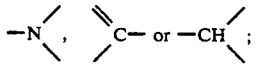

$R_4$ and $R_5$ respectively have the same meaning as $R_2$ and $R_3$, and each may represent —B—SZ; and a ring may be formed by the combination of $R_2$ and $R_3$, R and R′ or $R_4$ and $R_5$].

The compounds represented by the Formula [II] include the enolized products and their salts.

Formula [III]

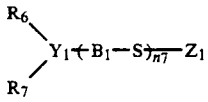

[wherein $R_6$ and $R_7$, which may combine with each other to form a ring, each represent hydrogen, alkyl with 1 to 6 carbon atoms, hydroxy, carboxy, amino, acyl with 1 to 3 carbon atoms, aryl, alkenyl or —$B_1$—S—$Z_1$; $Y_1$ represents

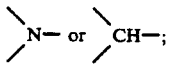

$B_1$ represents alkylene with 1 to 6 carbon atoms; $Z_1$ represents hydrogen, an alkali metal, ammonium, amino, a nitrogen-containing heterocyclic residue or

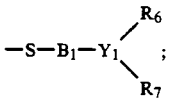

and $n_7$ represents an integer of 1 to 6]

Formula [IV]

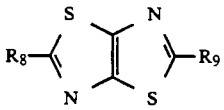

[wherein $R_8$ and $R_9$ each represent

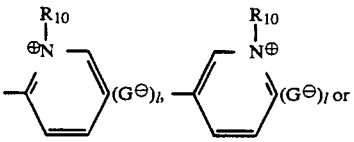

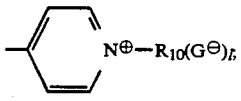

$R_{10}$ represents alkyl or —$(CH_2)_{n8}SO_3\ominus$ (when $R_{10}$ is —$(CH_2)_{n8}SO_3\ominus$, l is 0, and when $R_{10}$ is alkyl, l is 1); G ⊖ represents an anion; and $n_8$ represents an integer of 1 to 6]

Formula [V]

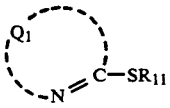

[wherein $Q_1$ represents a group of atoms necessary for forming a nitrogen-containing heterocyclic ring (including those formed by condensation of 5- or 6-membered saturated or unsaturated rings); $R_{11}$ represents hydrogen, an alkali metal,

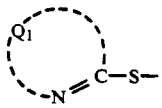

(where Q' has the same meaning as Q) or alkyl]

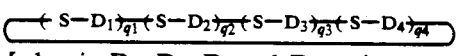

Formula [VI]

[wherein $D_1$, $D_2$, $D_3$ and $D_4$ each represent a bond, alkylene with 1 to 8 carbon atoms or vinylene; $q_1$, $q_2$, $q_3$ and $q_4$ each represent 0, 1 or 2; and a ring formed together with a sulfur atom may be condensed with a 5- or 6-membered ring]

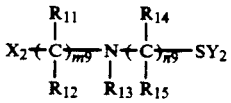

Formula [VII]

[wherein $X_2$ represents hydrogen, $R_{16}$, —COOM', —OH, —$SO_3M'$, —$CONH_2$, —$SO_2NH_2$, —$NH_2$, —CN, —$CO_2R_{16}$, —$SO_2R_{16}$, —$OR_{16}$, —$NR_{16}R_{17}$, —$SR_{16}$, —$SO_3R_{16}$, —$NHCOR_{16}$, —$NHSO_2R_{16}$ or —O-$COR_{16}$; $Y_2$ represents

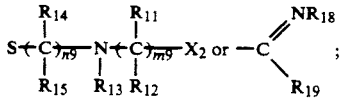

$m_9$ and $n_9$ each represent an integer of 1 to 10; $R_{11}$, $R_{12}$, $R_{13}$, $R_{14}$, $R_{15}$, $R_{17}$ *and* $R_{18}$ each represent hydrogen, alkyl, acyl,

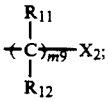

$R_{16}$ represents alkyl; $R_{19}$ represents —$NR_2OR_{21}$, —$OR_{22}$ or —$SR_{22}$; $R_2O$ and $R_{21}$, which each may combine with $R_{18}$ to form a ring, each represent hydrogen or alkyl; and $R_{22}$ represents a group of atoms necessary for forming a ring by its linkage to $R_{18}$]

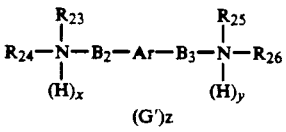

Formula [VIII]

[wherein Ar represents arylene or a divalent group formed by the combination of arylene and oxygen and/or alkylene; $B_2$ and $B_3$ each represent lower alkylene; $R_{23}$, $R_{24}$, $R_{25}$ and $R_{26}$ each represent hydroxy-substituted alkyl; x and y each represent 0 or 1; G' represents an anion; and z represents 0, 1 or 2]

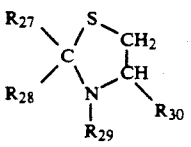

Formula [IX]

[wherein $R_{27}$ and $R_{28}$ each represent hydrogen, alkyl, aryl or a heterocyclic group; $R_{29}$ represents hydrogen or alkyl; and $R_{30}$ represents hydrogen or carboxyl]

Representative examples of the compounds represented by the Formulae [I] to [IX], imidazole and its derivatives include compound Nos (I-1) to (I-10), (II-1) to (II-27), (III 1), (III-15), (IV-1) to (IV-3), (V-1) to (V-23), (VI-1) to (VI-17), (VII-1) to (VII-15), (VIII-1) to (VIII-7), (IX-1) to (IX-5) and (A-1) to (A-8), which are described in Japanese Patent Application Specification No. 32501/1988, pp 17 to 39.

These compounds are normally employed as a bleach accelerator, and will be referred to as the "bleach accelerator" of the present invention.

These bleach accelerators may be employed either alone or in combination. Good results can be obtained when they are employed in amounts of 0 01 to 100 g per liter of the bleacher. If the amount of the bleach accelerator is too small, its bleach acceleration effect cannot be manifested sufficiently. If employed excessively, the bleach accelerator may precipitates, and eventually leads to the formation of stains in a light-sensitive material. Taking these into consideration, the amount of the bleach accelerator is preferably 0.05 to 50 g, more preferably 0.15 to 15 g, per liter of the bleacher.

The bleach accelerator may be added to the bleacher as it is, but preferably added in the form of a solution obtained by dissolving it in water, an alkali or an organic acid. In dissolution, an organic solvent such as methanol, ethanol and acetone may be used if need arises.

The pH of the bleacher is preferably 2.0 to 5.5, more preferably 3.0 to 5.0. Successful desilvering cannot be attained if the pH of the bleacher exceeds 5.5. When the bleacher has a pH lower than 2, though desilvering can be performed sufficiently, a leuco dye may be formed. Bleaching is performed preferably at 20° to 45° C., more preferably 25° to 42° C.

Normally, a halide such as ammonium bromide is added to the bleacher of the invention.

Next, the compounds represented by the Formula [B] will be explained in detail.

In the Formula [B], A represents a single bond or an n-valent group when n is 2, and represents a trivalent group when n is 3. M represents hydrogen, an alkali metal (e.g. sodium or potassium) or ammonium. When n is 2 or larger, M may be identical with or different from each other.

Representative examples of the compounds represented by the Formula [B] are given below.

| | |
|---|---|
| $HOOCCH_2C(OH)(COOH)CH_2COOH$ | (B-1) |
| $HOOC(CHOH)_2COOH$ | (B-2) |
| $HOOCCH_2COOH$ | (B-3) |
| $HOOCCH(OH)CH_2COOH$ | (B-4) |
| HOOCCH=CHCOOH | (B-5) |
| $HOOCCH_2CH_2COOH$ | (B-6) |
| $(COOH)_2$ | (B-7) |

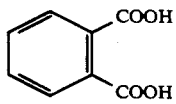

(B-8)

-continued

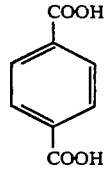

(B-9)

$NaOOCCH{=}CHCOONa$ (B-10)

$KOOCCH{=}CHCOOK$ (B-11)

$H_4NOOCCH{=}CHCOONH_4$ (B-12)

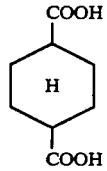

(B-13)

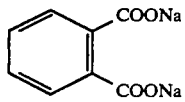

(B-14)

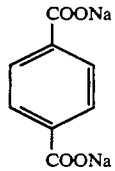

(B-15)

$HOOC{\leftarrow}CH_2{\rightarrow}_3COOH$ (B-16)

Of the compounds represented by the Formulae B-1 to 16, preferred are those represented by the Formulae B-1, B-3, B-4 and B-5. Especially preferred are those represented by the Formula B-5.

The compounds represented by the Formula [B] may be employed in the form of either an acid or a salt (e.g. potassium salts, sodium salts, ammonium salts, lithium salts, triethanolammonium salts).

The compounds represented by the Formula [B] are contained in the bleacher preferably in amounts of 0.05 to 2.0 mols, more preferably 0.1 to 1.0 mol, per liter of the bleacher.

The bleacher of the invention may contain a buffer in such an amount as will not affect adversely the effects of the invention. As the buffer, acetic acid is preferred in the invention.

Studies made by the inventors have revealed that the above-mentioned unfavorable odor problem ascribable to the use of acetic acid in a bleacher is closely related to the amount and pH of acetic acid. Even if a bleacher contains acetic acid of which the pH is within the scope of the invention, its adverse effects on working environments can be suppressed to a tolerable level as long as the amount does not exceed 0.6 mol/l (preferably 0.5 mol/l or less). In respect of buffer effect and cost, the use of a suitable amount of acetic acid with a suitable pH is advisable.

The bleacher of the invention may further contain a pH buffer consisting of a salt such as boric acid, borax, sodium hydroxide, potassium hydroxide, sodium carbonate, potassium carbonate, sodium bicarbonate, potassium bicarbonate or ammonium hydroxide. The use of two or more buffers in combination is also possible.

The bleacher may also contain a fluorescent bleacher, an antifoamer, a surfactant and fungicide.

The objects of the invention can be attained more successfully when the amount of ammonium ions contained in the bleacher accounts for 50 mol % or less, preferably 20 mol % or less, more preferably 10 mol % or less, of the total amount of cations contained in the bleacher.

Representative examples of the cations to be contained in the bleacher of the invention include ammonium ions, potassium ions, lithium ions, monomethyl ammonium, trimethyl ammonium and triethanol ammonium.

The amount of a replenisher for the bleacher is preferably 10 to 200 ml, more preferably 20 to 100 ml;, further more preferably 25 to 80 ml, most preferably 30 to 60 ml, per square meter of a light sensitive material.

In the method of the invention, it is preferred that a light-sensitive material be treated with the above-mentioned bleacher immediately after color development.

For rapid processing, bleaching with the above-mentioned bleacher is followed by treatment with a fixative liquid. In the invention, the fixative liquid means a fixer or a bleach-fixer.

Preferred examples of the processing method according to the invention include:

(1) Color developing—bleaching—fixing—rinsing
(2) Color developing—bleaching—fixing—rinsing—stabilizing
(3) Color developing—bleaching—fixing—stabilizing
(4) Color developing—bleaching—fixing—1st stabilizing—2nd stabilizing
(5) Color developing—bleaching—bleach—fixing—rinsing
(6) Color developing—bleaching—bleach—fixing—rinsing—stabilizing
(7) Color developing—bleaching—bleach—fixing—stabilizing
(8) Color developing—bleaching—bleach—fixing—1st stabilizing—2nd stabilizing Of the above methods, (3), (4), (6), (7) and (8) are preferable. Methods (3), (4) and (7) are more preferable. Method (3) is most preferable.

A fixer or a bleach-fixer to be employed in the method of the invention must contain a fixing agent.

Suitable fixing agents include thiosulfates such as potassium thiosulfate, sodium thiosulfate, ammonium thiosulfate; thiocyanates such as potassium thiocyanate, sodium thiocyanate and ammonium thiocyanate; thiourea; and thioethers. Of them, thiosulfates and thiocyanates are preferred. Stain formation can be suppressed, though not greatly, when the amount of ammonium ions contained in the fixer or the bleach-fixer accounts for not more than 50%, preferably not more than 20%, of the total amount of cations contained in the fixer of the bleach-fixer.

The fixer or the bleach-fixer may further contain a pH buffer consisting of a sulfite such as ammonium sulfite, potassium sulfite, ammonium bisulfite, potassium bisulfite, sodium bisulfite, ammonium metabisulfite, potassium metabisulfite and sodium metabisulfite, or a salt such as boric acid, borax, sodium hydroxide, potassium hydroxide, sodium carbonate, potassium carbonate, sodium bicarbonate, potassium bicarbonate, acetic acid, sodium acetate or ammonium hydroxide. The use of two or more buffers in combination is possible.

It is also possible to add to the fixer or the bleach-fixer a large amount of a re-halogenating agent such as alkali halides and ammonium halides (e.g. potassium bromide, sodium bromide, sodium chloride, ammonium bromide). Other additives that have been conventionally employed for a fixer or a bleach-fixer may also be added to the fixer or the bleach-fixer to be used in the invention. Such additives include a pH buffer such as borates, oxalates, acetates, carbonates and phosphates; alkylamines and polyethylene oxides.

The above fixing agents are employed normally in amounts of not less than 0.1 mol, preferably 0.2 to 3 mols, more preferably 0.25 to 2 mols, most preferably 0.3 to 1.0 mol, per liter of the fixer or the bleach-fixer.

To activate the fixer or the bleach-fixer, air or oxygen may be blown into the bath or into the replenisher storage tank. Activation may be performed also by the addition of a suitable oxidant, for instance, hydrogen peroxide, a bromate or a persulfate.

In practicing the present invention, unnecessary silver may be recovered from the fixer or the bleach-fixer by known methods, for example, by an electrolysis method (see French Patent No. 2,299,667), a precipitation method (see Japanese Patent O.P.I. Publication No. 73037/1977 and German Patent No. 2,331,220), an ion exchange method (see Japanese Patent Examined Specification No. 17114/1976 and German Patent No. 2,548,237) and a metal substitution method (see British Patent No. 1,353,805).

For rapid processing, it is desirable to recover unnecessary silver directly from a fixer (or bleach fixer) tank by the in line system. But it is also possible to recover silver particles from an overflow for reusing.

The objects of the invention can be attained more successfully when the amount of a replenisher for the fixer or the bleach-fixer is 300 ml or less, preferably 20 to 200 ml, more preferably 30 to 100 ml, per square meter of a light-sensitive material.

Bleaching time is not critical, but better results can be obtained when bleaching is performed for 1 minutes and 30 seconds or shorter. Bleaching time is more preferably 10 to 70 seconds, most preferably 15 to 55 seconds.

Time for the treatment with a fixative liquid is not limitative, but preferably not longer than 2 minutes, more preferably 5 to 90 seconds, most preferably 10 to 60 seconds The cross-over time between color developer tank and bleach tank is preferably 10 seconds or shorter, more preferably 7 seconds or shorter.

For the successful attainment of the objects of the invention, and for rapid processing, it is preferred that the bleach, the fixer or the bleach-fixer be subjected to stirring. Stirring, in this context, means stirring performed by stirring means, and does not mean natural diffusion movement of a liquid. Suitable stirring methods include:

1 High pressure spray method or spray stirring method
2. Air bubbling method
3. Ultrasonic oscillation method
4. Vibration method In the methods (1), a processing liquid (bleach, fixer or bleach-fixer) is sprayed from a spray nozzle or a nozzle, which is being immersed in the liquid, at a pressure of 0.1 kg/cm$^2$ or larger to a light-sensitive material. As a pressure source, a pressure pump or a liquid transporting pump is generally employed. Examples of pressure pumps include plunger pumps, gear pumps, magnet pumps and cascade pumps. Commercially available pressure pumps are, for instance, 15-LPM, 10-BFM, 20-BFM and 25-BFM manufactured by Maruyama Seisaku sho.

MD-30, MD-56, MDH-25 and MDK-32 (manufactured by Iwaki Co. Ltd.) are employable as the liquid-transporting pump.

Nozzles and spray nozzles to be employed in the methods (1) are classified, according to the shape or direction of a liquid sprayed, into bee-line types, fan types, circular types, overall types, ring types, or the like. It is preferred that nozzles can give a light-sensitive material an impact sufficient to make the light-sensitive material tremble. The impact strength of a liquid sprayed from a nozzle is dependent mainly on the flow rate of the liquid (l/min) and the pressure of spraying (kg/cm$^2$). For successful stirring, the provision of a pressurizer is needed so that the spraying pressure can be controlled in accordance with the number of nozzles employed. The most preferable spraying pressure is 0.3 to 10 kg/cm$^2$. If spraying is performed at a pressure lower than 0.3 kg/cm$^2$, stirring will be unsuccessful. A pressure higher than 10 kg/cm$^2$ may result in the formation of scratches or the destruction of a light-sensitive material.

In the air bubbling method, air or an inert gas is supplied to a sparger provided at the bottom of a conveying roller in a processing liquid tank, and bubbles ejected from the sparger cause a light-sensitive material to vibrate. By this method, the both surfaces of a light-sensitive material as well as the sides thereof can be effectively in touch with a processing liquid.

Suitable materials for a sparger include corrosion-proof substances such as rigid vinyl chloride, polyethylene-coated stainless steel and sintered metals. A sparger is perforated such that the size of bubbles ejected from a hole formed by the perforation will be 2 to 30 mm, preferably 5 to 15 mm. The supply of air or an inert gas to a sparger is performed by using an air compressor (e.g. Baby type compressor, manufactured by Hitachi Ltd.) or an air pump (e.g. Ap220, manufactured by Iwaki Co. Ltd.). The amount of air or an inert gas is preferably 21/min to 301/min, more preferably 51/min to 201/min, per rack of an automatic processing machine. The amount of air or an inert gas must be controlled according to the size of a processing liquid tank and the amount of light-sensitive materials to be processed. It is preferable to supply air or an inert gas in such an amount as will make a light-sensitive material vibrate with a vibration amplitude of 0.2 to 20 mm.

In the ultrasonic vibration method, an ultrasonic vibrator is provided in a space near the bottom or the side wall of a processing liquid tank, thereby allowing a light-sensitive material to be exposed to ultrasonic waves. The effects of stirring can be enhanced by ultrasonic waves. Usable ultrasonic vibrators include magnetostrictive nickel vibrators (horn type), magnetostrictive ferrite vibrators (plate type) and magnetostrictive barium titanate vibrators (holder type), which are manufactured by Ultrasonic Waves Kogyo Sha.

The vibration frequency is normally 5 to 1000 KHz. In the invention, for sufficient stirring as well as for the protection of a light-sensitive material from damage, a ultrasonic vibrator preferably has a frequency of 10 to 50 KHz. A light-sensitive material may be exposed to ultrasonic waves either directly or indirectly through a reflection board provided between a light-sensitive material and a ultrasonic vibrator. In view of a fact that ultrasonic waves decay in proportion to the distance between a vibrator and a light-sensitive material, it is preferable to expose a light-sensitive material directly to ultrasonic waves. Exposure time is preferably 1 second or longer. Partial exposure is also possible. In this case, exposure may be conducted at any stage of processing, i.e., the initial stage, the middle stage, or the final stage of processing.

In the vibration method, a light-sensitive material is caused to vibrate between an upper roller and a lower roller provided in a processing liquid tank. As a vibrator, V-2B and V-4B (manufactured by Shinko Denki Co., Ltd) may be employed. A vibrator is fixed at the top of a processing liquid tank, so that it's vibrating tip can be in contact with the backside of a light-sensitive material. Vibration frequency is preferably 100 to 10,000 times per minute, more preferably 500 to 6,000 times per minute. A light-sensitive material vibrates preferably with a vibration amplitude of 0.2 to 30 mm, more preferably 1 to 20 mm. If the vibration amplitude is smaller than 0.2 mm, effective stirring cannot be performed. A vibration amplitude larger than 20 mm may result in the formation of scratches on a light sensitive material. The number of vibrator is dependent on the size of an automatic processing machine. When an automatic processing machine consists of a plurality of processing tanks, it is preferred that at least one vibrator be provided in each tank.

In the method of the invention, color developing time is preferably 210 seconds or shorter.

The color developer to be used in the method of the invention contains an aromatic primary amine-based color developer in an amount preferably $5.0\times10^{-3}$ mol or more, more preferably $1.0\times10^{-2}$ mol, most preferably $1.2\times10^{-2}$ to $2\times10^{-1}$ mol, per liter of the color developer.

As the aromatic primary amine-based color developing agent, use can be made of those which have conventionally been employed in various color photographic processes. These color developing agents include aminophenol or p-phenylenediamine derivative;. Being stable in free states, these compounds are employed in the form of salts, such as hydrochlorides or sulfates. Examples of the aminophenol-based developing agents include o-aminophenol, p-aminophenol, 5-amino-2-oxytoluene, 2-amino-3-oxy-toluene, and 2 oxy 3-amino-1,4-dimethyl-benzene.

To attain the objects of the invention more sufficiently, and to prevent a color developing agent from precipitating on the inner wall of a bleacher tank, it is preferable to employ an aromatic primary amine-based color developing agent with an amino group and at least one water-soluble group. The most preferred example of such agent are those represented by the following Formula [D]:

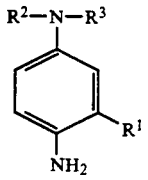

Formula [D]

In the formula, $R_1$ represents hydrogen, halogen or alkyl. The alkyl is linear or branched alkyl with 1 to 5 carbon atoms, and may have a substituent.

$R_2$ and $R_3$ each represent hydrogen, alkyl or aryl. The alkyl or aryl each may have a substituent. At least one of $R_2$ and $R_3$ must be alkyl substituted with a water-soluble group such as hydroxy, carboxyl, sulfonyl, amino and sulfoneamide, or $-[(CH_2)_qO]_pR^4$. The alkyl group may further have a substituent.

$R_4$ represents hydrogen or alkyl. The alkyl is linear or branched alkyl with 1 to 5 carbon atoms. p and q each represent an integer of 1 to 5.

Examples of the compounds represented by the Formula [D] are given below.

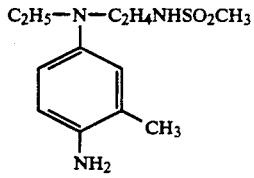

(D-1)

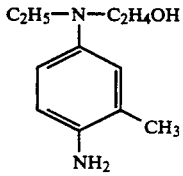

(D-2)

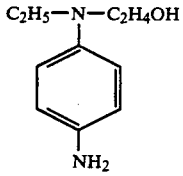

(D-3)

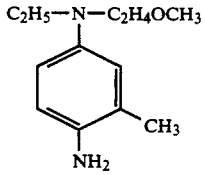

(D-4)

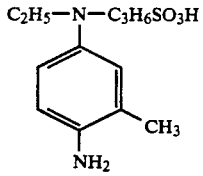

(D-5)

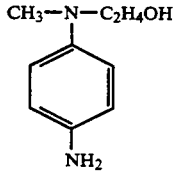

(D-6)

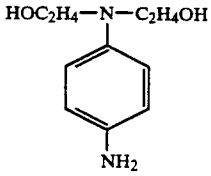

(D-7)

-continued (D-8)

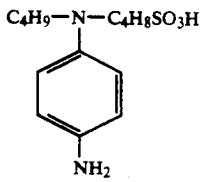

(D-9)

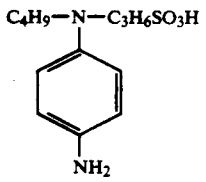

(D-10)

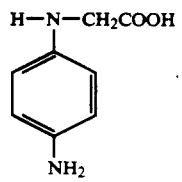

(D-11)

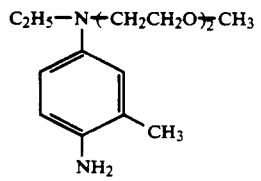

(D-12)

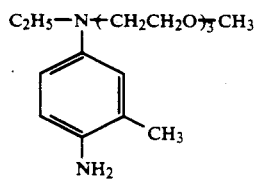

(D-13)

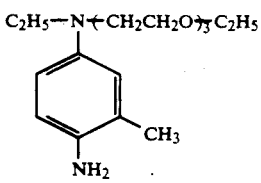

(D-14)

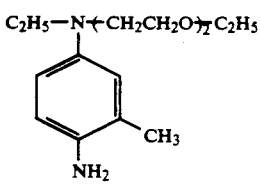

(D-15)

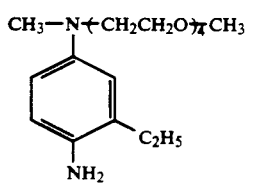

-continued (D-16)

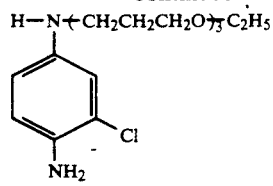

The p-phenylenediamine derivatives represented by these formulae are employed in the form of organic or inorganic salts, such as hydrochlorides, sulfates, phosphates, p-toluenesulfonates, sulfites, oxalates and benzenesulfonates.

Of the p-phenylenediamine derivatives represented by the Formula [D], compound D-1 is most preferable for the successful manifestation of the effects of the invention.

In the invention, a sulfite can be used as a preservative for the color developer. Suitable sulfites include sodium sulfite, sodium bisulfite, potassium sulfite and potassium bisulfite. The amount of a sulfit; is $1.0\times10^{-2}$ mol or less, preferably $5.0\times10^{-3}$ mol or less, per liter of the color developer. The use of no sulfite is most preferable.

Other usable preservatives than sulfites include organic preservatives such as hydroxylamine, hydroxylamine derivatives described in Japanese Patent O.P.I. Publication Nos. 146043/1988, 146042/1988, 146041/1988, 146040/1988, 135938/1988 and 118748/1988, hydroxamic acids described in Japanese Patent O.P.I. Publication No. 62639/1989, hydrazines, hydrazides, phenols, α-hydroxyketones, α-aminoketones, sugar, monoamines, diamines, quaternary ammonium salts, nitroxyradicals, alcohols, oxims, diamides, condensed ring amines.

The objects of the invention can be attained satisfactorily when the compound represented by the following Formula [A'] or [B'] is added to the color developer as a preservative.

Formula [A']

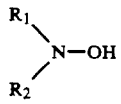

In the formula, $R_1$ and $R_2$ each represent hydrogen, alkyl, aryl or

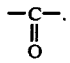

R' represents alkoxy, alkyl or aryl. $R_1$ and $R_2$ cannot be hydrogen simultaneously. $R_1$ and $R_2$ may combine with each other to form a ring.

In the Formula [A'], $R_1$ and $R_2$ each represent hydrogen, alkyl, aryl or

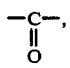

provided that $R_1$ and $R_2$ cannot be hydrogen simultaneously. When $R_1$ and $R_2$ are both alkyl, they may be either identical or different. It is preferred that the alkyl group represented by $R_1$ or $R_2$ have 1 to 3 carbon atoms. R' represents alkoxy, alkyl or aryl. The alkyl group and the aryl group represented by $R_1$, $R_2$ or R' each may have a substituent. $R_1$ and $R_2$ may combine with each other to form a ring, for instance a heterocyclic ring such as piperidine, pyridine, triazine and morpholine.

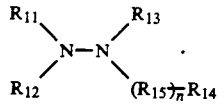

Formula [B']

In the formula, $R_{11}$, $R_{12}$ and $R_{13}$ each represent hydrogen, or alkyl, aryl, or a heterocyclic group, which may be substituted, and $R_{14}$ represents hydroxy, hydroxyamino, or alkyl, aryl, a heterocyclic group, alkoxy, aryloxy, carbamoyl or amino, each of which may be substituted. The heterocyclic group represented by $R_{11}$, $R_{12}$ or $R_{13}$ is a 5- to 6-membered ring consisting of C, H, O, N, S and halogen atoms, and may be either saturated or unsaturated. $R_{15}$ represents a divalent group selected from CO—, —$SO_2$— and

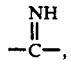

and n represents 0 or 1. When n is 0, $R_{14}$ represents a group selected from alkyl, aryl and a heterocyclic group. $R_{13}$ and $R_{14}$ may combine with each other to form a ring.

An explanation will be made on the compounds represented by the Formulae [A'] and [B'].

Specific examples of the hydroxylamine-based compounds represented by the Formula [A'] are given in U.S. Pat. Nos. 3,287,125, 3,293,034 and 3,287,124. Preferable hydroxylamine-based compounds are given below.

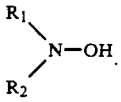

| Example compound No. | $R_1$ | $R_2$ |
|---|---|---|
| A'-1 | $-C_2H_5$ | $-C_2H_5$ |
| A'-2 | $-CH_3$ | $-CH_3$ |
| A'-3 | $-C_3H_7$(n) | $-C_3H_7$(n) |
| A'-4 | $-C_3H_7$(i) | $-C_3H_7$(i) |
| A'-5 | $-CH_3$ | $-C_2H_5$ |
| A'-6 | $-C_2H_5$ | $-C_3H_7$(i) |
| A'-7 | $-CH_3$ | $-C_3H_7$(i) |
| A'-8 | —H | $-C_2H_5$ |
| A'-9 | —H | $-C_3H_7$(n) |
| A'-10 | —H | $-CH_3$ |
| A'-11 | —H | $-C_3H_7$(i) |
| A'-12 | $-C_2H_5$ | $-C_2H_4OCH_3$ |
| A'-13 | $-C_2H_4OH$ | $-C_2H_4OH$ |
| A'-14 | $-C_2H_4SO_3H$ | $-C_2H_5$ |
| A'-15 | $-C_2H_4COOH$ | $-C_2H_4COOH$ |
| A'-16 | 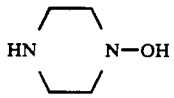 | |
| A'-17 | 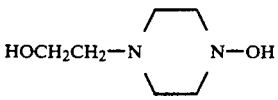 | |

-continued

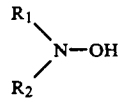

| Example compound No. | $R_1$ | $R_2$ |
|---|---|---|
| A'-18 | 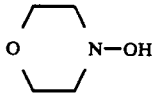 | |
| A'-19 | 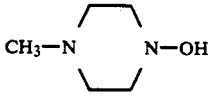 | |
| A'-20 | $-CH_3$ | $-C_2H_4OCH_3$ |
| A'-21 | $-C_2H_4OCH_3$ | $-C_2H_4OCH_3$ |
| A'-22 | $-C_2H_4OC_2H_5$ | $-C_2H_4OC_2H_5$ |
| A'-23 | $-C_3H_6OCH_3$ | $-C_3H_6OCH_3$ |
| A'-24 | $-C_2H_5$ | $-C_2H_4OC_2H_5$ |
| A'-25 | $-C_3H_7$ | $-C_2H_4OCH_3$ |
| A'-26 | $-CH_3$ | $-C_2H_4OC_2H_5$ |
| A'-27 | $-CH_3$ | $-CH_2OCH_3$ |
| A'-28 | $-C_2H_5$ | $-CH_2OC_2H_5$ |
| A'-29 | $-CH_2OCH_3$ | $-CH_2OCH_3$ |
| A'-30 | $-C_2H_5$ | $-C_2H_4OC_3H_7$ |
| A'-31 | $-C_3H_6OC_3H_7$ | $-C_3H_6OC_3H_7$ |
| A'-32 | 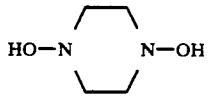 | |
| A'-33 | 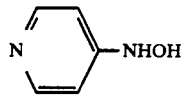 | |
| A'-34 | 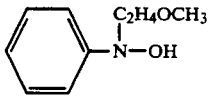 | |
| A'-35 | 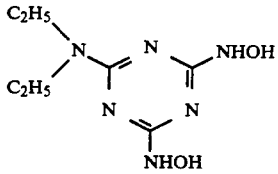 | |
| A'-36 | $CH_3CO-NHOH$ | |
| A'-37 | $C_4H_9O-C(=O)-NHOH$ | |
| A'-38 | 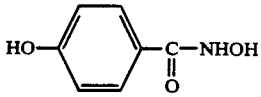 | |
| A'-39 | $H_2N-C(=O)-NHOH$ | |
| A'-40 | 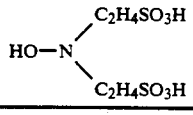 | |

In the Formula [B'], it is preferred that $R_{11}$, $R_{12}$ and $R_{13}$ be hydrogen or alkyl with 1 to 10 carbon atoms. It is especially preferred that $R_{11}$ and $R_{12}$ be hydrogen. $R_{14}$ is preferably alkyl, aryl, carbamoyl or amino. It is especially preferred that $R_{14}$ be alkyl or substituted alkyl. Suitable substituents for the alkyl group represented by $R_{14}$ include carboxyl, sulfo, nitro, amino and phosphono. Specific examples of the compounds represented by the Formula [B'] are given below.

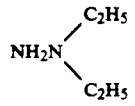
B'-1

$NH_2NH(CH_2)_4SO_3H$ B'-2

$NH_2NH(CH_2)_2OH$ B'-3

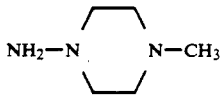
B'-4

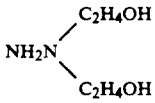
B'-5

$NH_2NHCOCH_3$ B'-6

$NH_2NHCOOC_2H_5$ B'-7

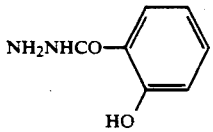
B'-8

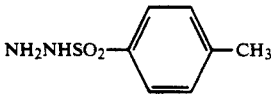
B'-9

$NH_2NHCONH_2$ B'-10

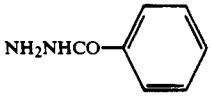
B'-11

$NH_2NHSO_3H$ B'-12

$NH_2NHC(=NH)NH_2$ B'-13

$NH_2NHCOCONHNH_2$ B'-14

$NH_2NHCH_2CH_2CH_2SO_3H$ B'-15

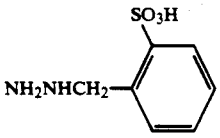
B'-16

$NH_2NHCH(C_4H_9(n))COOH$ B'-17

$NH_2NHCH_2CH_2COOH$ B'-18

-continued

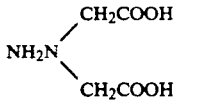
B'-19

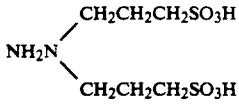
B'-20

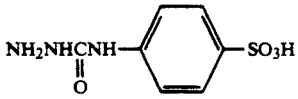
B'-21

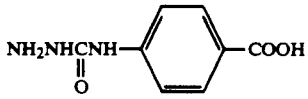
B'-22

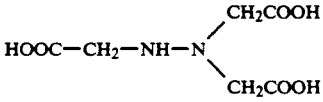
B'-23

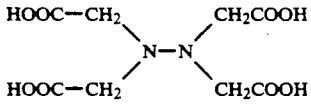
B'-24

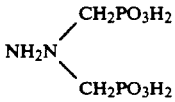
B'-25

$HOOCCH_2NHNHCH_2COOH$ B'-26

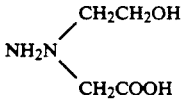
B'-27

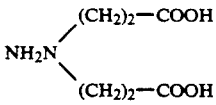
B'-28

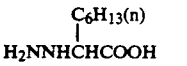
B'-29

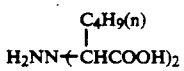
B'-30

$H_2NN(CH_2CH_2SO_3H)_2$ B'-31

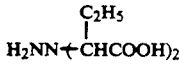
B'-32

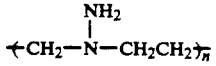
B'-33

Average molecular weight: about 4,000

The compounds represented by the Formula [A'] or [B']are employed in the form of free amines, hydrochlorides, sulfates, p-toluenesulfonates, oxalates, phosphates or acetates.

The compounds represented by the Formula [A'] or [B']are contained in the color developer normally at concentrations of 0.4 to 100 g/l, preferably 1.0 to 60 g/l, more preferably 2 to 30 g/l.

Of the compounds represented by the Formulae [A'] and [B'], compound Nos. A'-1, A'-2, A'-10, A'-13, A'-18, A'-21, B-5, B-19 and B-20 are especially preferable in the invention.

The compounds represented by the Formula [A'] or [B']may be used in combination with conventional hydroxylamine preservatives and other organic preservatives. For improved developing performance, it is preferred that the color developer contain no hydroxylamine.

In the invention, the compounds represented by the Formula [A'] or [B'] may be employed either alone or in combination.

Examples of development inhibitors that can be advantageously employed in the invention include halides such as sodium chloride, potassium chloride, sodium bromide, potassium bromide, sodium iodide and potassium iodide and other organic inhibitors. These development inhibitors are employed preferably in amounts of 0.005 to 30 g, more preferably 0.01 to 20 g, per liter of the color developer.

For the successful attainment of the objects of the invention, it is preferable to add a triazinyl stilbene-based fluorescent brightening agent to the color developer.

Preferred triazinyl stilbene-based fluorescent brightening agent are those represented by the following Formula [E]:

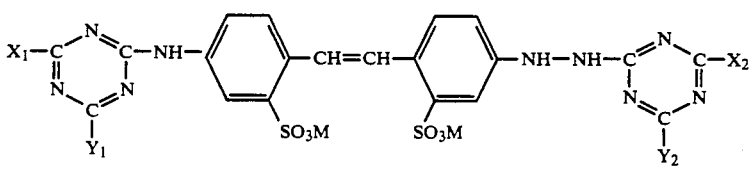

Formula [E]

In the formula, $X_1$, $X_2$, $Y_1$ and $Y_2$ each represent hydroxy, halogen (e.g. chlorine and bromine), alkyl (e.g. methyl and ethyl), aryl (e.g. phenyl and methoxyphenyl),

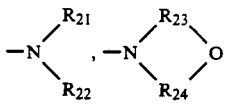

or —$OR_{25}$ (where $R_{21}$ and $R_{22}$ each represent hydrogen, alkyl that may have a substituent, or aryl that may have a substituent; $R_{23}$ and $R_{24}$ each represent alkylene that may have a substituent; $R_{25}$ represents hydrogen, alkyl that may have a substituent or aryl that may have a substituent). M represents a cation (e.g. sodium, potassium, lithium, ammonium). The alkyl group represented by $R_{21}$, $R_{22}$ or $R_{25}$ preferably has 1 to 6 carbon atoms. The alkylene group represented by $R_{23}$ or $R_{24}$ preferably has 1 to 2 carbon atoms.

Preferable substituents for the alkyl group and the aryl group represented by $R_{21}$, $R_{22}$ or $R_{25}$ and the alkylene group represented by $R_{23}$ or $R_{24}$ include hydroxy, sulfo, sulfoamino and carboxyamino.

Specific examples of

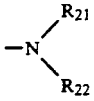

include amino; alkylamino [e.g. methylamino, ethylamino, propylamino, dimethylamino, cyclohexylamino, β-hydroxyethylamine, di(β-hydroxyethyl-)amino, β-sulfoethylamino, N-(β-sulfoethyl)-N-methylamino, N-(β-hydroxyethyl-N-methylamino]; and arylamino (e.g. anilino, o-, m-, p-sulfoanilino, o-, m-, p-chloroanilino, o-, m-, p-toluidino, o-, m-, p-carboxyanilino, o-, m-, p-hydroxyanilino, sulfonaphthylamino, o , m-, p-aminoanilino, o-, m-, p-anilino). Examples of

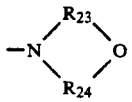

include morpholino , and those of —$OR_{25}$ include alkoxy (e.g. methoxy, ethoxy, methoxyethoxy) and aryloxy (e.g. phenoxy, p-sulfophenoxy).

Of the compounds represented by the Formula [E], preferable are those in which $X_1$, $X_2$, $Y_1$ and $Y_2$ are each

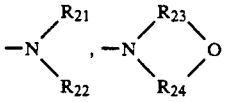

or —$OR_{25}$. Most preferred are those in which one of $X_1$ and $Y_1$ is —$OR_{25}$, and the other is

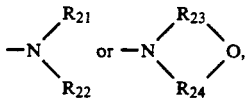

and at the same time, one of $X_2$ and $Y_2$ is —$OR_{25}$, and the other is

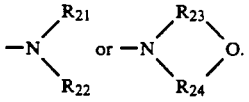

The representative examples of such compounds are given below.

| Compound No. | M | $X_1$ | $Y_1$ | $X_2$ | $Y_2$ |
|---|---|---|---|---|---|
| E-1 | Na | 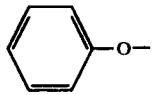 | $-NHC_2H_4OH$ | $-NHC_2H_4OH$ | 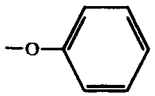 |
| E-2 | Na | $HOC_2H_4NH-$ | $-NHC_2H_4OH$ | $-NHC_2H_4OH$ | $-NHC_2H_4OH$ |
| E-3 | Na | 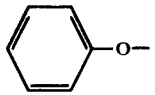 | $-N(C_2H_4OH)_2$ | $-N(C_2H_4OH)_2$ | 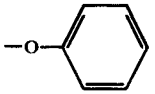 |
| E-4 | Na | $(HOC_2H_4)_2N-$ | $-OCH_3$ | $-OCH_3$ | $-NHC_2H_4SO_3Na$ |
| E-5 | Na | $HOCH(CH_2OH)CH_2NH-$ | $-N(C_2H_4OH)_2$ | $-N(C_2H_4OH)_2$ | $-NHCH_2CH(CH_2OH)OH-$ |
| E-6 | Na | $(HOC_2H_4)_2N-$ | $-N(C_2H_4OH)_2$ | $-N(C_2H_4OH)_2$ | $-N(C_2H_4OH)_2$ |
| E-7 | Na | 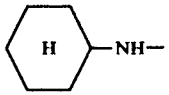 | $-NHC_2H_4OH$ | $-NHC_2H_4OH$ | 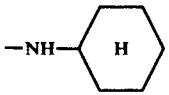 |
| E-8 | Na | 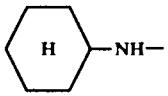 | $-N(C_2H_4OH)_2$ | $-N(C_2H_4OH)_2$ | 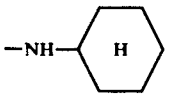 |
| E-9 | Na | $-OH$ | 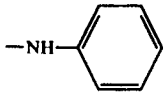 | 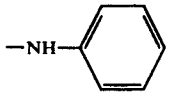 | $-OH$ |
| E-10 | Na | $H_2N-$ | 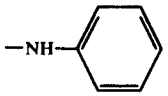 | 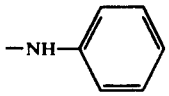 | $-NH_2$ |
| E-11 | Na | $CH_3O-$ | 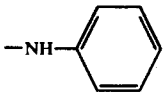 | 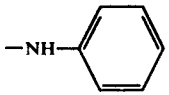 | $-OCH_3$ |

-continued
| Compound No. | M | $X_1$ | $Y_1$ | $X_2$ | $Y_2$ |
|---|---|---|---|---|---|
| E-12 | Na | $HOC_2H_4NH-$ | 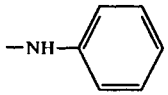 | 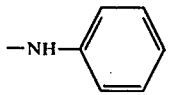 | $-NHC_2H_4OH$ |
| E-13 | Na | $(HOC_2H_4)_2N-$ | 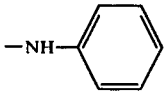 | 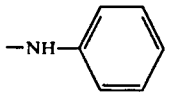 | $-N(C_2H_4OH)_2$ |
| E-14 | Na | $HOC_2H_4NH-$ | 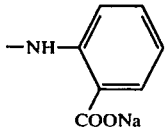 | 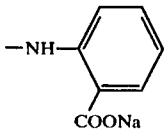 | $-NHC_2H_4OH$ |
| E-15 | Na | 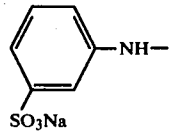 | $-N(C_2H_4OH)_2$ | $-N(C_2H_4OH)_2$ | 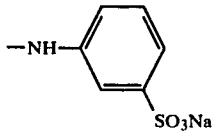 |
| E-16 | Na | 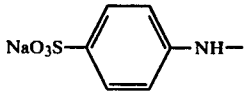 | $-N(C_2H_4OH)_2$ | $-N(C_2H_4OH)_2$ | 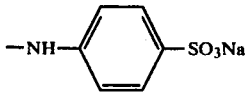 |
| E-17 | Na | 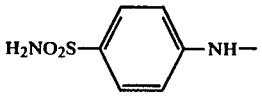 | $-N(C_2H_4OH)_2$ | $-N(C_2H_4OH)_2$ | 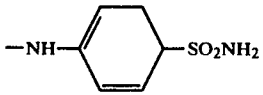 |
| E-18 | Na | 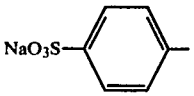 | $-N(C_2H_4OH)_2$ | $-N(C_2H_4OH)_2$ | 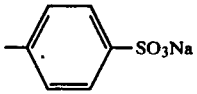 |
| E-19 | Na | $HOCH_2CH(CH_3)CH_2NH-$ | $CH_3O-$ | $CH_3O-$ | $-NHCH_2-CH(CH_3)-OH$ |

-continued
| Compound No. | M | $X_1$ | $Y_1$ | $X_2$ | $Y_2$ |
|---|---|---|---|---|---|
| E-20 | Na | $(HOC_2H_4)_2N-$ | 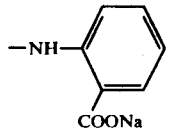 | 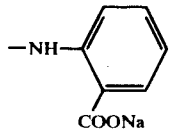 | $-N(C_2H_4OH)_2$ |
| E-21 | Na | $HOC_2H_4NH-$ | 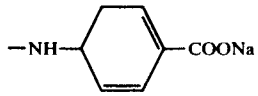 | 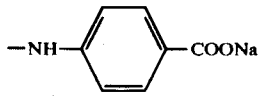 | $-NHC_2H_4OH$ |
| E-22 | Na | 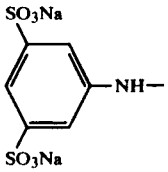 | $-NHC_2H_5$ | $-NHC_2H_5$ | 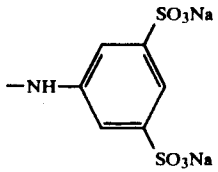 |
| E-23 | Na | 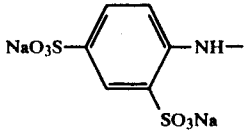 | $-NHC_2H_5$ | $-NHCH$ | 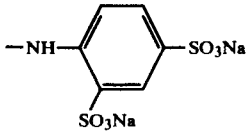 |
| E-24 | Na | 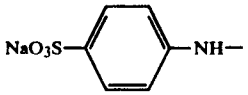 | 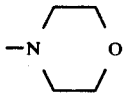 | 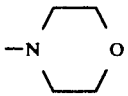 | 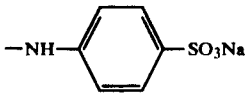 |
| E-25 | Na | $HOC_2H_4NH-$ | 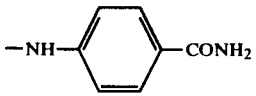 | 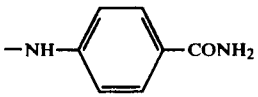 | $-NHC_2H_4OH$ |
| E-26 | Na | $HOC_2H_4NH-$ | 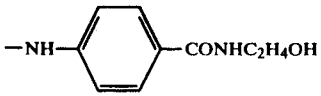 | 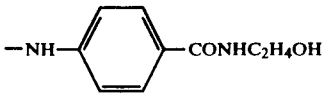 | $-NHC_2H_4OH$ |

-continued
| Compound No. | M | $X_1$ | $Y_1$ | $X_2$ | $Y_2$ |
|---|---|---|---|---|---|
| E-27 | Na | $(HOC_2H_4)_2N-$ | 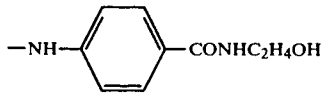 | 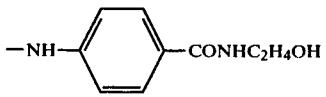 | $-N(C_2H_4OH)_2$ |
| E-28 | Na | $HOC_2H_4NH-$ | 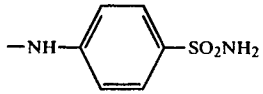 | 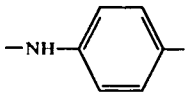 | $-NHC_2H_4OH$ |
| E-29 | Na | $HOC_2H_4NH-$ | 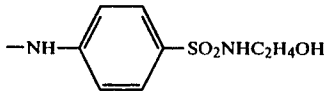 | 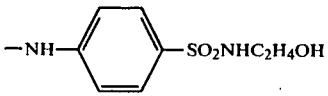 | $-NHC_2H_4OH$ |
| E-30 | Na | $(HOC_2H_4)_2N-$ | 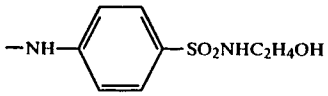 | 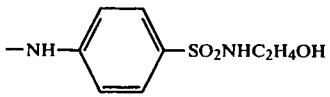 | $-N(C_2H_4OH)_2$ |
| E-31 | Na | 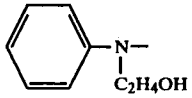 | 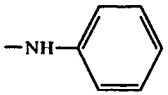 | 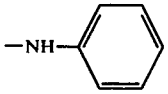 | 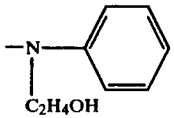 |
| E-32 | Na | 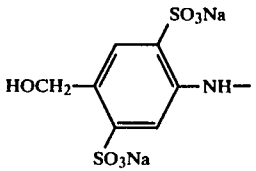 | 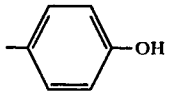 | 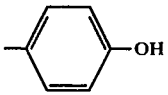 | 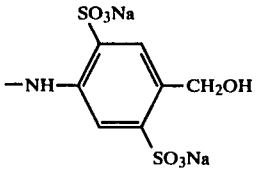 |
| E-33 | Na | 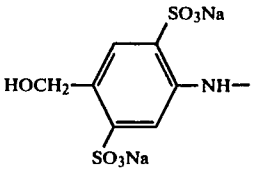 | $-NHC_2H_5$ | $-NHC_2H_5$ | 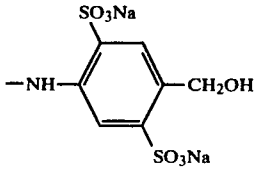 |
| E-34 | Na | $CH_3O-$ | $-NHCH_2CH(OH)CH_3$ | $-NHCH_2CH(OH)CH_3$ | $-OCH_3$ |

-continued
| Compound No. | M | $X_1$ | $Y_1$ | $X_2$ | $Y_2$ |
|---|---|---|---|---|---|
| E-35 | Na | 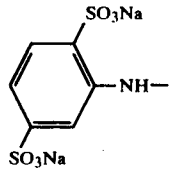 | 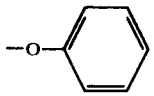 | 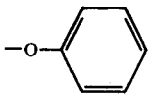 | 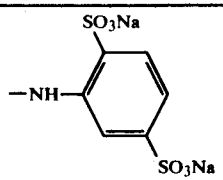 |
| E-36 | Na | 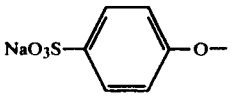 | $-N(C_2H_4OH)_2$ | $-N(C_2H_4OH)_2$ | 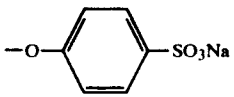 |
| E-37 | Na | 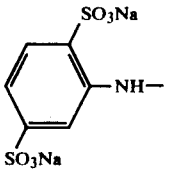 | $-N(C_2H_5)_2$ | $-N(C_2H_5)_2$ | 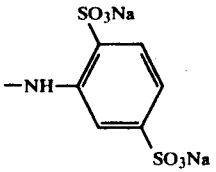 |
| E-38 | Na | 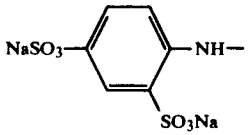 | $-NHCH_3$ | $-NHCH_3$ | 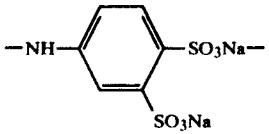 |
| E-39 | Na | $CH_3O-$ | $-NH-CH(CH_2OH)CH_3$ | $-NH-CH(CH_2OH)CH_3$ | $-OCH_3$ |
| E-40 | Na | $CH_3O-$ | $-NH(C_2H_4OH)_2$ | $-N(C_2H_4OH)_2$ | $-OCH_3$ |
| E-41 | Na | $CH_3O-$ | $-NHC_2H_4SO_3Na$ | $-NHC_2H_4SO_3Na$ | $-OCH_3$ |
| E-42 | Na | $CH_3O-$ | $-NH(C_2H_4OH)_2$ | $-NH(C_2H_4OH)$ | $-OCH_3$ |
| E-43 | Na | $CH_3O-$ | 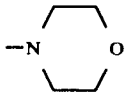 | 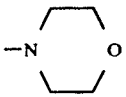 | $-OCH_3$ |
| E-44 | Na | $CH_3O-$ | $NHC_2H_4SO_3K$ | $-N(C_2H_4OH)_2$ | $-OCH_3$ |
| E-45 | Na | 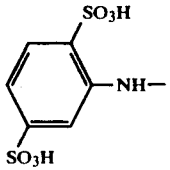 | $-N(C_2H_5)_2$ | $-N(C_2H_5)_2$ | 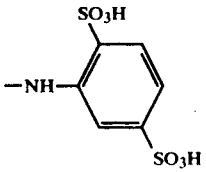 |

These triazinyl stilbene-based brightening agent can be prepared by the method described in "Fluorescent Brightening agent", ed. Institute for Chemical Products (August 1976), page 8.

Of the compounds shown above, preferred are compound Nos. E-4, E-24, E-34, E-35, E-36, E-37 and E-41.

These triazinyl stilbene-based brightening agent are contained in the color developer preferably in amounts of 0.2 to 10 g, more preferably 0.4 to 5 g, per liter of the developer.

In the invention, the color developer may further contain organic solvents such as methyl cellosolve, methanol, acetone, dimethylformamide, β-cyclodextrine, and compounds described in Japanese Patent Examined Publication Nos. 33378/1972 and 9509/1969. These organic solvents increase the solubility of the color developing agent.

Auxiliary developing agents may be used in combination with the color developing agents. Suitable auxiliary developing agents include N-methyl-p-aminophenol-hexasulfate (methol), phenidone, N,N-diethyl-p-aminophenol hydrochloride and N,N,N',N'-tetramethyl-p-phenylenediamine hydrochloride. They are employed in amounts of 0.01 to 1.0 g per liter of the developer.

The color developer may further contain various additives such as anti-stain agents, anti-sludging agents and developing accelerators.

Stain formation can be effectively prevented when the color developer of the invention contains a chloride (e.g. potassium chloride, sodium chloride, lithium chloride, hydrogen chloride) in an amount of at least $2.5\times10^{-2}$ mol, preferably $3.0\times10^{-2}$ to $20\times10^{-2}$ mol, more preferably $3.5\times10^{-2}$ to $15\times10^{-2}$ mol, per liter of the developer.

The color developer of the invention may contain an anionic, amphoteric or nonionic surfactant.

The color developer of the invention can be prepared byadding ingredients to a prescribed amount of water, followed by stirring. In the case of ingredients which are soluble in water only slightly, it is advisable to dissolve them in an organic solvent such as triethanolamine before adding to water.

Most generally, the color developer of the invention can be prepared by dissolving two or more ingredients (ingredients that can coexist stably) in water to form a thick aqueous solution, adding the solution to water, followed by stirring. In the above process, the ingredients may be used in solid states without dissolving in water.

The pH of the color developer is not limitative, but preferably 9.5 to 13.0, more preferably 9.8 to 12.0, to perform processing rapidly. Color development is normally conducted at 38° C. or higher, preferably 38.3° to 43.0° C., more preferably 39° to 41° C., and completed preferably within 90 seconds, more preferably 3 to 60 seconds, especially preferably 5 to 45 seconds.

Examples of organic development inhibitors that can be advantageously used in the invention include nitrogen-containing heterocyclic compounds, mercapto group-containing compounds, aromatic compounds, onium compounds and compounds containing an iodine atom in its substituent.

The amount of a replenisher for the color developer of the invention is not more than 160 ml, preferably 20 to 120 ml, more preferably 30 to 100 ml, most preferably 40 to 80 ml, per square meter of a light-sensitive material.

In emulsion layers of a light-sensitive material to be processed by the method of the invention, the amount of silver chloride contained in silver halide grains accounts for preferably not less than 50 mol %, more preferably not less than 80 mol %, further more preferably not less than 90 mol %, most preferably not less than 98 mol %, of the total amount of silver halides contained therein. Further, the total silver coating weight of a light-sensitive material before processing must not exceed 1 g, preferably 0.1 to 0.8 g, more preferably 0.3 to 0.7 g, per square meter of the light sensitive material.

Besides silver chloride, silver bromide or silver iodide preferably constitutes a silver halide grain. A silver halide emulsion to be employed for preparing a light-sensitive material to be processing by the method of the invention (hereinafter often referred to as the silver halide emulsion of the invention) contains silver chlorobromide, silver chloride or silver chloroiodobromide. If the silver halide grains of the invention comprise solid solution crystals such as silver chlorobromide or silver chloroiodobromide, it is preferred that silver bromide or silver iodide be localized in a specific site of each crystal.

When silver halide grains contained in a light-sensitive material to be processed by the method of the invention (hereinafter often referred to as the silver halide grains of the invention) is silver chlorobromide grains, it is preferred that silver bromide be localized at the apex or in the vicinity of the apex of each crystal. Such silver halide grains can be prepared by allowing a sensitizing dye or an inhibitor to be adsorbed on the surfaces silver chloride or silver chlorobromide grains and adding silver bromide fine grains for ripening. Instead of the addition of silver bromide fine particles, a solution of a water-soluble bromide can be added for halogen substitution.

When the silver halide grains of the invention are silver chloroiodobromide grains, it is preferred that silver iodide be localized in the interior portion of each grain.

A silver chloroiodobromide grain with silver iodide being localized in its inside can be prepared by allowing silver chloride or silver chlorobromide to be deposited on a core containing silver iodide. The deposition can be performed by a known method for growing silver halide crystals, such as the double-jet method or the Ostwald's ripening method.

It is preferred that the core have a silver iodide content of not less than 10 mol %, more preferably 15 to 40 mol %, and that the core consist of silver iodobromide.

The silver halide emulsion as mentioned above can be prepared by methods described in Japanese Patent O.P.I. Publication Nos. 6941/1989, 26839/1989, 121848/1990 and 38550/1990.

When the silver halide grain of the invention contains silver iodide, the amount of silver iodide accounts for preferably 20 mol % or less, more preferably 12 mol % or less, most preferably 0 to 5 mol %, of the amount of the entire grain.

The silver halide grain of the invention may be either a regular crystal (e.g. cubic, tetradecahedral, octahedral) or a twin crystal (e.g. tabular). Silver halide grains can be grown into a desired shape by controlling pAg and pH during precipitation. As described in Japanese Patent O.P.I. Publication Nos. 11935/1983, 11936/1983, 11937/1983, 108528/1983, 163046/1987, 41845/1988 and 212932/1988, octahedral or tabular grains can be prepared by growing crystals in the presence of an adsorptive sensitizing dye or an inhibitor.

The average grain size of the silver halide grains of the invention is preferably 0.05 to 10 μm, more preferably 0.1 to 5 μm, most preferably 0.2 to 3 μm.

In combination with the silver halide grains of the invention, other silver halide grains can be employed in such an amount as will not affect adversely the effects of the invention. In this case, the weight of the silver halide grains of the invention accounts for preferably 30% or more, more preferably 50% or more, most preferably 80% or more, of the total weight of silver halide grains.

The localization of halogen in a silver halide grain can be confirmed by an X-ray diffraction method, or by subjecting a dispersion of silver halide grains in a resin to X-ray microanalysis.

In the invention, it is preferred that a silver halide emulsion to be employed for preparing a light-sensitive material be monodispersed. A monodispersed emulsion means an emulsion containing 70 wt % or more (preferably 80 wt % or more, more preferably 90 wt % or more) of grains with their sizes falling within the range of 80 to 120% of the average grain size $\bar{d}$.

The average grain size $\bar{d}$ is defined as a diameter $d_1$ with which the product of $d_1^3$ and the number of grains with a diameter of $d_1$ $n_1$ is maximized. The significant figure is calculated down to the third decimal place and the fourth digit is rounded to the nearest whole number.

The size of a grain as referred to herein means a diameter of a circle having the same area as the projected image of the grain.

Grain size can be measured by a process that comprises: dispersing grains on a flat table (care must be taken not to allow grains to lay one on another), taking an electron microphotograph of grains (magnification: × 10,000 to 50,000); and measuring the diameters of 1,000 or more grains (selected arbitrarily) appearing on the photograph, or measuring the areas of projected images of these grains.

The silver halide emulsion of the invention preferably has a variation coefficient of not more than 20%, more preferably not more than 15%, wherein the variation coefficient is defined by the following equation:

$$\frac{\text{Standard deviation of grain size}}{\text{Average grain size}} \times 100 = \text{Variation coefficient (\%)}$$

In the above equation, the average grain size is an arithmetic average.

$$\text{Average grain size} = \frac{\Sigma d_1 n_1}{\Sigma n_1}$$

The silver halide emulsion layers of a light-sensitive material to be processed by the method of the invention each contain a coupler. A coupler reacts with an oxidized product of a color developing agent to form a non-diffusible dye. A coupler is contained in a light-sensitive layer or in a layer adjacent to the light-sensitive layer in a non-diffusible form.

A red-sensitive layer may contain at least one non-diffusible coupler which forms a cyan dye, such as a phenol or α-naphthol-based coupler. A green-sensitive layer may contain at least one non-diffusible coupler which forms a magenta dye, such as a 5-pyrazolone- or pyrazolotriazole-based coupler. A blue-sensitive layer may contain at least one non-diffusible coupler that forms a yellow dye, such as a coupler with a closed ketomethylene group. These couplers may be 2-, 4, or 6-equivalent coupler. In the invention, 2-equivalent couplers are preferable.

Suitable couplers are described in the following publications: W. Pelz, "Farbkuppler", Mitteilunglnausden Forschungslaboratorien der Agfa, Leverkusen/Munchen, Vol. III (1961), p. 111; The Chemistry of Synthetic Dyes, Vol.4, pp 341–387, Academic Press, The Theory of the Photographic Process, 4th ed., pp 353–362; and Research Disclosures No. 17643, Section VII.

In the invention, for the successful attainment of the objects of the invention, it is preferable to use magenta couplers represented by Formula [M-1] described on page 26 of Japanese Patent O.P.I. Publication No. 106655/1988 (specifically, compound Nos. 1 to 77 given on pages 29 to 34 of this publication), cyan couplers represented by Formula [C-I] or [C-II] described on page 34 of this publication (specifically, compound Nos. C'-1 to 82, C''-1 to 36 given on pages 37 to 42 of this publication), and high-speed yellow couplers described on page 20 of this publication (specifically, compound Nos. Y'-1 to 39 given on pages 21 to 26 of this publication).

The objects of the invention can be attained more satisfactorily when use is made of a cyan coupler represented by the following Formula [PC-I] or [PC-II].

Formula [PC-I]

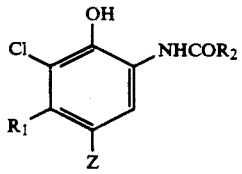

[wherein $R_1$ represents alkyl with 2 to 6 carbon atoms; $R_2$ represents a ballast group; Z represents hydrogen or a group which can be released upon a reaction with an oxidized product of a color developing agent]

Formula [PC-II]

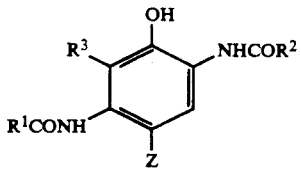

[wherein $R_1$ represents alkyl or aryl; $R_2$ represents alkyl, cycloalkyl, aryl or a heterocyclic ring; $R_3$ represents hydrogen, halogen, alkyl or alkoxy; $R_3$ and $R_1$ may combine with each other to form a ring; and Z represents a group which can be released upon a reaction with an oxidized product of a color developing agent]

In the Formula [PC-I], the alkyl group represented by $R_1$ may be either linear or branched, and may have a substitutent. The ballast group represented by $R_2$ is an organic group which has such size and shape as will make the coupler molecule big enough to prevent the coupler from diffusing into other layers than one in which it exists. A preferred ballast group is represented by the following formula:

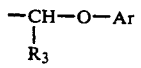
Where, $R_3$ represents alkyl with 1 to 12 carbon atoms, and Ar represents aryl such as phenyl. The aryl may have a substituent.
Specific examples of the coupler represented by the Formula [PC-I] are give below.
Formula [PC-I]
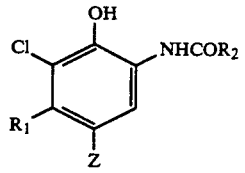
| Coupler No. | $R_1$ | Z | $R_2$ |
|---|---|---|---|
| C-1 | $-C_2H_5$ | $-Cl$ | 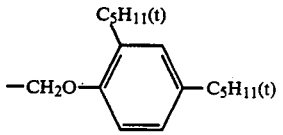 |
| C-2 | $-C_2H_5$ | 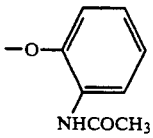 | 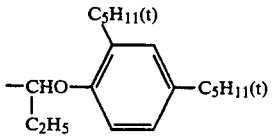 |
| C-3 | 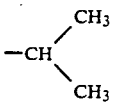 | $-Cl$ | 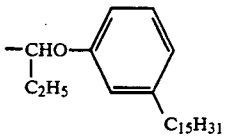 |
| C-4 | $-C_2H_5$ | $-Cl$ | 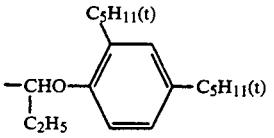 |
| C-5 | $-C_4H_9$ | $-F$ | 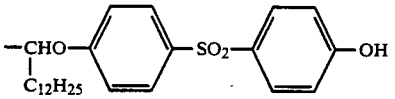 |
| C-6 | $-C_2H_5$ | $-F$ | 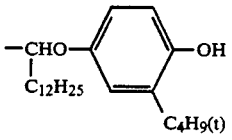 |
| C-7 | $-C_2H_5$ | $-Cl$ | 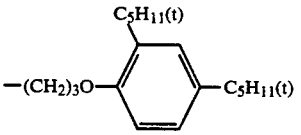 |
| C-8 | $-C_2H_5$ | $-Cl$ | 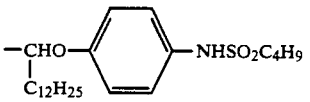 |

-continued
Formula [PC-I]
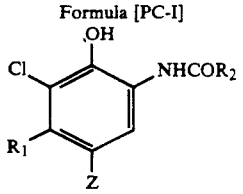
| Coupler No. | $R_1$ | Z | $R_2$ |
|---|---|---|---|
| C-9 | $-C_2H_5$ | $-Cl$ | 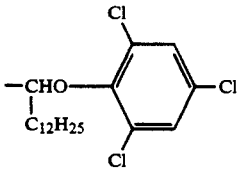 |
| C-10 | $-CH(CH_3)_2$ | $-Cl$ | $-C_{18}H_{37}$ |
| C-11 | $-C_6H_{13}$ | $-Cl$ | 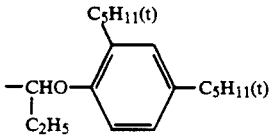 |
| C-12 | $-C_3H_7$ | $-Cl$ | 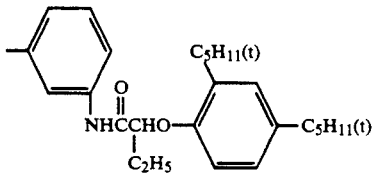 |
| C-13 | $-C_2H_4NHC(=O)CH_3$ | $-Cl$ | 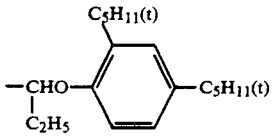 |
| C-14 | $-C_2H_4OCH_3$ | $-Cl$ | 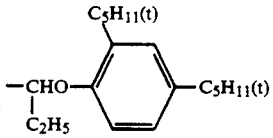 |
| C-15 | $-C_2H_5$ | $-Cl$ | 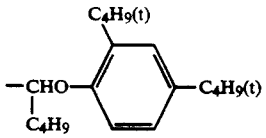 |
| C-16 | $-C_4H_9(t)$ | $-OCH_2CH_2-SO_2CH_3$ | 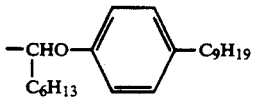 |
| C-17 | $-C_2H_5$ | $-Cl$ | 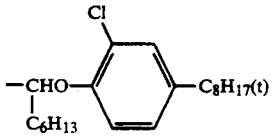 |
| C-18 | $-C_2H_5$ | $-Cl$ | 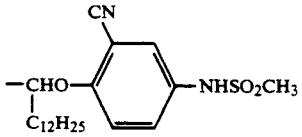 |

-continued

Formula [PC-I]

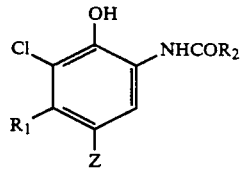

| Coupler No. | $R_1$ | Z | $R_2$ |
|---|---|---|---|
| C-19 | $-C_2H_5$ | $-Cl$ | 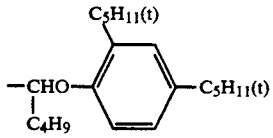 |
| C-20 | $-C_2H_5$ | $-Cl$ | $-C_{15}H_{31}(n)$ |

Representative examples of cyan couplers usable in the invention, including those listed above, are described in Japanese Patent Examined Specification No. 11572/1974, Japanese Patent O.P.I. Publication Nos. 3142/1986, 9652/1986, 9653/1986, 39045/1986, 50136/1986, 99141/1986 and 105545/1986.

The cyan couplers represented by the Formula [PC-I] are normally employed in amounts of $1\times10^{-7}$ to 1 mol, preferably $1\times10^{-2}$ to $8\times10^{-1}$ mol, per mol of a silver halide.

In the Formula [PC-II], the alkyl group represented by $R^1$ may be either linear or branched, and preferably has 1 to 32 carbon atoms. This alkyl group may have a substituent. The aryl group represented by $R^1$ is preferably phenyl, and may have a substituent. The alkyl group represented by $R^2$ may be either linear or branched, and preferably has 1 to 32 carbon atoms. This alkyl group may have a substituent. The cycloalkyl group represented by $R^2$ ay have a substituent, and has preferably 3 to 12 carbon atoms. The aryl group represented by $R^2$ is preferably phenyl, and may have a substituent. The heterocyclic group represented by $R^2$ is preferably 5- to 7-membered, and may have a substituent. The ring may be condensed. $R^3$ represents hydrogen, halogen alkyl or alkoxy. The alkyl and alkoxy groups each may have a substituent. It is preferred that $R^3$ be hydrogen. The ring formed by $R^1$ and $R^2$ is preferably a 5- to 6-membered ring, such as

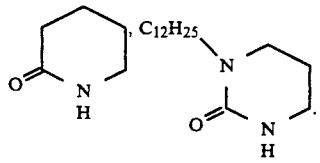

Examples of the group represented by Z (a group that can be released upon a reaction with an oxidized product of a color developing agent) include halogen, alkoxy, aryloxy, acyloxy, sulfonyloxy, acylamino, sulfonylamino, alkoxycarbonyloxy, aryloxycarbonyloxy and imide. These groups each may have a substituent. Of them, halogen, aryloxy and alkoxy are preferable.

Of such cyan couplers, those represented by the following Formula [PC-II-A] are preferable.

Formula [PC-II-A]

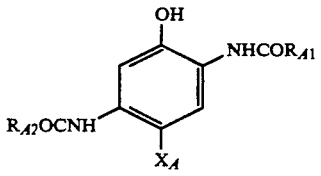

In the formula, $R_{A-1}$ represents phenyl substituted with at least one halogen atom. The phenyl group may further contain a substituent other than halogen atoms. $R_{A-2}$ has the same meaning as $R_1$. $X_A$ represents halogen, aryloxy or alkoxy. The aryloxy and alkoxy groups each may have a substituent.

Representative examples of the cyan coupler represented by the Formula [PC-II] are given below.

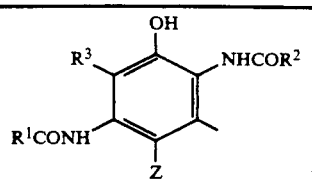
| Example Compound No. | $R^2$ | $R^1$ | $R^3$ | Z |
|---|---|---|---|---|
| PC-II-1 | $-(CF_2)_4H$ | 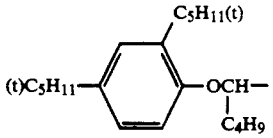 | H | —Cl |
| PC-II-2 | 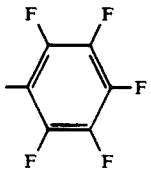 | 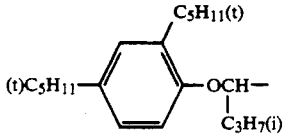 | H | —Cl |
| PC-II-3 | 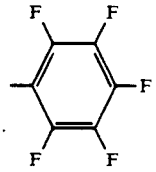 | 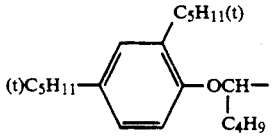 | H | —Cl |
| PC-II-4 | 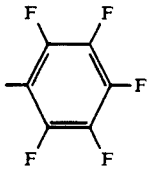 | $C_{16}H_{33}$— | —Cl | —Cl |
| PC-II-5 | 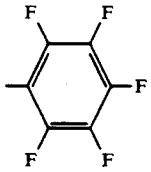 | 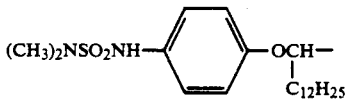 | H | 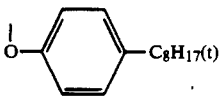 |
| PC-II-6 | 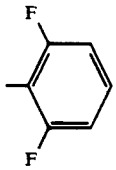 | 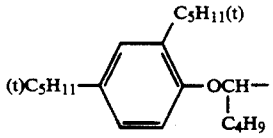 | H | H |
| PC-II-7 | 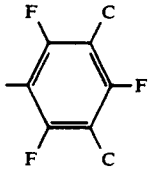 | 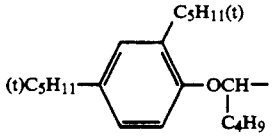 | H | —Cl |
| PC-II-8 | 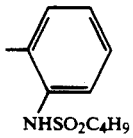 | 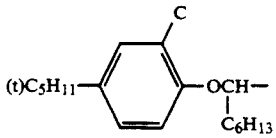 | H | —Cl |

-continued
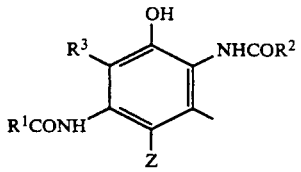
| Example Compound No. | $R^2$ | $R^1$ | $R^3$ | Z |
|---|---|---|---|---|
| PC-II-9 | 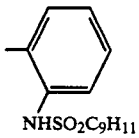 | 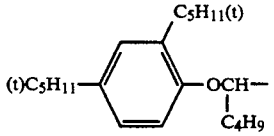 | H | 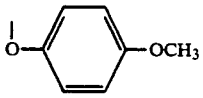 |
| PC-II-10 | 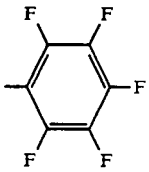 | 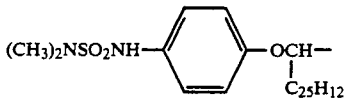 | H | —Cl |
| PC-II-11 | 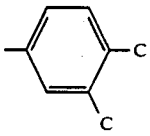 | 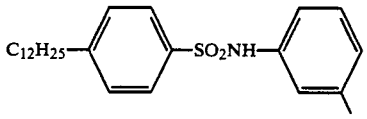 | H | —Cl |
| PC-II-12 | 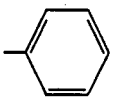 | 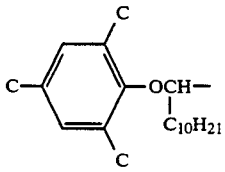 | H | $-OCH_2CONHC_3H_7$ |
| PC-II-13 | 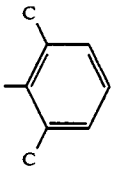 | 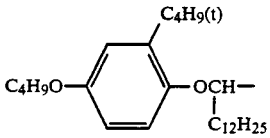 | H | —Cl |
| PC-II-14 | 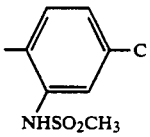 | 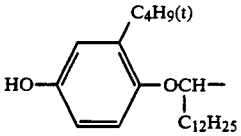 | H | —Cl |
| PC-II-15 | 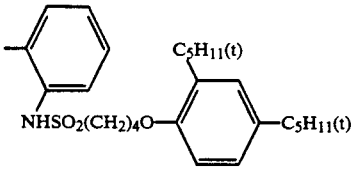 | 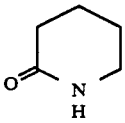 | H | —Cl |
| PC-II-16 | 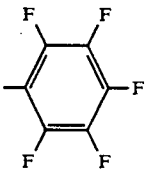 | 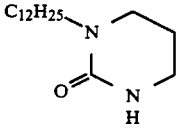 | | —Cl |

-continued
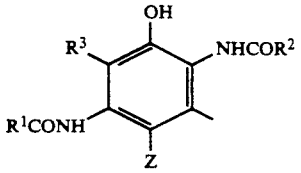
| Example Compound No. | $R^2$ | $R^1$ | $R^3$ | Z |
|---|---|---|---|---|
| PC-II-17 | 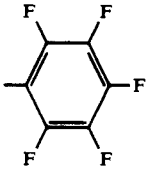 | 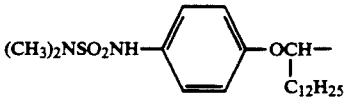 | | —Cl |
| PC-II-18 | 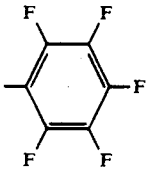 | 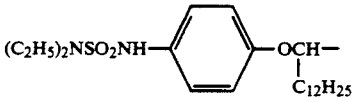 | H | —Cl |
| PC-II-19 | 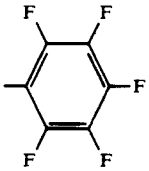 | 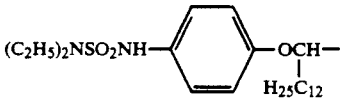 | H | 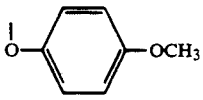 |
| PC-II-20 | 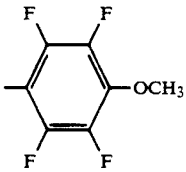 | 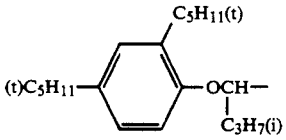 | H | —Cl |
| PC-II-21 | 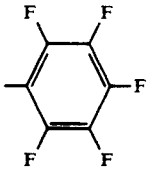 | 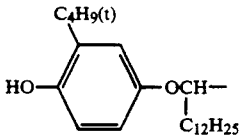 | H | —Cl |
| PC-II-22 | 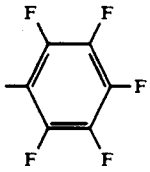 | 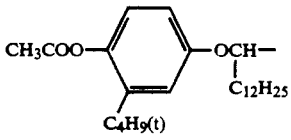 | H | —Cl |
| PC-II-23 | 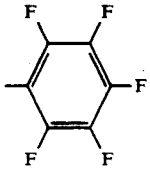 | 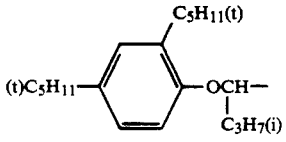 | H | 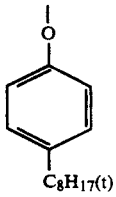 |

-continued
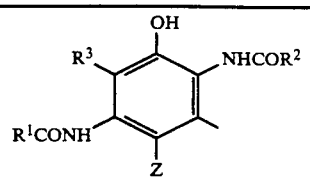
| Example Compound No. | $R^2$ | $R^1$ | $R^3$ | Z |
|---|---|---|---|---|
| PC-II-24 | 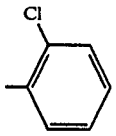 | 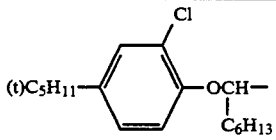 | H | —Cl |
| PC-II-25 | 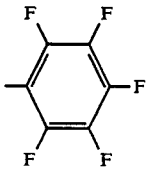 | 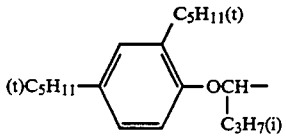 | H | 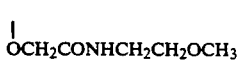 |
| PC-II-26 | 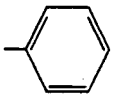 | 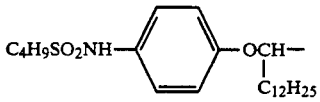 | H | —Cl |
| PC-II-27 | $-C_3F_7$ | 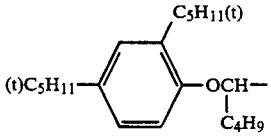 | H | H |
| PC-II-28 | $-C_3F_7$ | 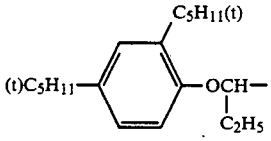 | H | H |
| PC-II-29 | 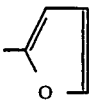 | 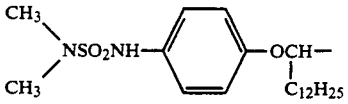 | H | Cl |
| PC-II-30 | 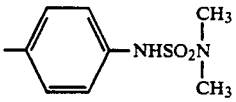 | 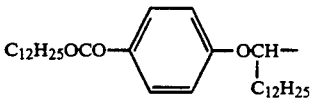 | $CH_3O$ | Cl |
| PC-II-31 | 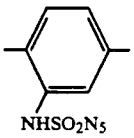 | 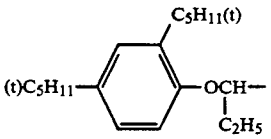 | H | Cl |
| PC-II-32 | $-C_3F_7$ | 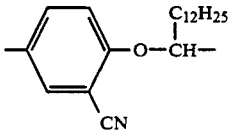 | H | H |
Besides those listed above, use can be made of 2,5-diacylamino-based cyan couplers described in Japanese Patent Application Specification No. 21853/1986, pp. 26 to 35, Japanese Patent O.P.I. Publication Nos. 225155/1985, p. 7, the lower left column to p. 10, the upper right column, Japanese Patent O.P.I. Publication No. 222853/1985, p. 6, the upper left column to p. 8, the lower right column, and Japanese Patent O.P.I. Publication No. 185335/1984, p. 6, the lower left column to p. 9, the upper left column. These couplers can be prepared by methods described in these specification and publications.

The cyan couplers represented by the Formula [PC-II] is contained in a red sensitive emulsion layer preferably in amounts of $2\times10^{-3}$ to $8\times10^{-1}$ mol, more preferably $1\times10^{-2}$ to $5\times10^{-1}$ mol, per mol of a silver halide.

In the case of a light-sensitive material prepared from an emulsion consisting mainly of silver chloride, the objects of the invention can be attained successfully and adverse effects on photographic properties by the admixture of a color developer with a bleach-fixer can be minimized by the use of a nitrogen-containing mercapto compound.

Examples of such nitrogen-containing mercapto compound include compound Nos. I'-1 to I'-87 described in Japanese Patent O.P.I. Publication No. 106655/1988, pp. 42–45.

A silver halide emulsion consisting mainly of silver chloride can be prepared by a known method, such as the single-jet method and the double-jet method. The pAg-controlled double-jet method is especially preferred (see Research Disclosure No. 17643, Sections I and II).

An emulsion containing silver chloride as its main component can be chemically sensitized. As a chemical sensitizer, use can be made of sulfur-containing compounds such as allylthiocyanates, allylthioureas and thiosulfates. A reducing agent may be employed as a chemical sensitizer. Suitable reducing agents are silver compounds described in Belgian Patent Nos. 493,464 and 568,687 and polyamines such as diethylenetriamine and aminomethylsulfinic acid derivatives described in Belgian Patent No. 547,323. Noble metals such as gold, platinum, palladium, iridium, ruthenium and rhodium and nobel metal compounds are also usable as sensitizers. Chemical sensitization with these nobel metals and nobel metal compounds is discussed in R. Kosiovsky's report printed in Z. Wiss. Photo., 46, pp. 65–72 (1951). Also see Research Disclosure No. 17643, Section III for details.

The emulsion consisting mainly of silver chloride can be optically sensitized by using conventional optical sensitizers such as normal polymethine dyes (e.g. nitrocyanine, basic or acidic carbocyanine, rhodacyanine, hemicyanine), styryl dyes, oxonol and related compounds. See F.M. Hamer, "The Cyanine Dyes and Related Compounds" (1964), Ullmanns Enzykipadie der Technischen Chemie, 4th ed., Vol. 18, pp. 431–432, and Research Disclosure No. 17643, Section IV.

The emulsion consisting mainly of silver chloride may contain an antifoggant and a stabilizer which have conventionally been employed in the industry. Azaindene, in particular, tetraazaindene and pentaindene, is suitable as the stabilizer. Tetraazaindene or pentaazaindene substituted with a hydroxyl group or an amino group is especially preferable. These compounds are described in a Birr's report printed in Z. Wiss. Photo, 47, .952, pp. 2–58, and Research Disclosure No. 17643, Section IV.

Incorporation of ingredients, including couplers and additives, in a light sensitive material can be performed in normal ways. See U.S. Pat. Nos. 2,322,027, 2,533,514, 3,689,271, 3,764,336 and 3,765,897. A coupler and a UV absorber may be contained in a light-sensitive material in the form of a charged latex. See German Patent O.P.I. Publication No. 2,541,274 and European Patent No. 14,921 for details. Ingredients may be incorporated in a light-sensitive material in the form of a polymer. See German Patent O.P.I. Publication No. 2,044,992 and U.S. Pat. Nos. 3,370,952 and 4,080,211.

The support of a light-sensitive material which is to be processed by the method of the invention is reflexive. As compared with transmissible supports, reflexive supports tend to cause the formation of stains in the white background of a photoprint. The commercial value of a photoprint is significantly impaired by such stains. The present invention has been made to solve the problem involved in the use of reflexive supports.

As the reflexive support, use can be made of a paper support coated with a polyolefin, in particular, polyethylene or polypropylene. Examples of such polyolefin-coated paper support are given in Research Disclosure No. 17643, Section VI. Also usable are synthetic polyester films which have been rendered opaque by adding a white pigment, followed by molecular orientation; and synthetic polyester films with their one side or both sides being coated with a white pigment. For details, see Japanese Patent O.P.I. Publication No. 72248/1986.

In the invention, a silver halide light-sensitive material which contains couplers in its emulsion layers, should be processed by the conventional color development method. The present invention can be applied to color negative paper, color reversal paper and direct positive paper.

EXAMPLES

The present invention will be described in more detail according to the following examples.

EXAMPLE 1

The both sides of a paper support was coated with polyethylene. Titanium oxide was added to one side. On this titanium oxide containing polyethylene layer, layers of the following composition were provided in sequence, whereby a silver halide color photographic light-sensitive material of multilayer structure (Sample 1) was obtained. Coating liquids for these layers were prepared by the following methods.

1st Layer 26.7 g of a yellow coupler (Y-1), 10.0 g of a dye image stabilizer (ST-1), 6.67 g of another dye image stabilizer (ST-2) and 0.67 g of an additive (HQ-1) were dissolved in 6.5 g of a high boiling solvent (DNP) together with 60 ml of ethyl acetate. The resulting solution was dispersed in 220 ml of a 10% aqueous gelatin solution that contained 7 ml of a 20% surfactant (SU-1) and emulsified by means of a ultrasonic homogenizer, whereby a yellow coupler dispersion was obtained. This yellow coupler dispersion was mixed with a blue-sensitive silver halide emulsion (silver content: 10 g) which had been prepared by the method described later, thereby to obtain a coating liquid for the 1st emulsion layer.

Coating liquids for the 2nd to 7th layers were prepared in substantially the same manner as in the preparation of the 1 st layer. The 2nd, the 4th and the 7th layers each contained a hardener (H-1 for the 2nd and the 4th layers, and H-2 for the 7th layer). The surface tension of each coating liquid was controlled by the addition of surfactants (SU-2, SU-3).

| Layer | Composition | Amount added ($g/m^2$) |
|---|---|---|
| 7th Layer (protective layer) | Gelatin | 1.1 |
| | Fungicide (F-1) | 0.002 |
| 6th Layer (UV absorbing layer) | Gelatin | 0.35 |
| | UV absorber (UV-1) | 0.10 |
| | UV absorber (UV-2) | 0.06 |
| | UV absorber (UV-3) | 0.16 |
| | Anti-stain agent (HQ-1) | 0.02 |
| | DNP | 0.2 |
| | PVP | 0.03 |
| | Anti-irradiation dye (AI-2) | 0.02 |
| 5th Layer (red-sensitive layer) | Gelatin | 1.20 |
| | Red-sensitive chlorobromide emulsion (Em-R) in terms of the amount of silver | 0.20 |
| | Cyan coupler (C-1) | 0.21 |
| | Cyan coupler (C-2) | 0.20 |
| | Dye image stabilizer (ST-1) | 0.20 |
| | Anti-stain agent (HQ-1) | 0.01 |
| | HBS-1 | 0.20 |
| | DOP | 0.25 |
| 4th Layer (UV absorbing layer) | Gelatin | 1.0 |
| | UV absorber (UV-1) | 0.28 |
| | UV absorber (UV-2) | 0.1 |
| | UV absorber (UV-3) | 0.38 |
| | Anti-stain agent (HQ-1) | 0.03 |
| | DNP | 0.35 |

-continued

| Layer | Composition | Amount added ($g/m^2$) |
|---|---|---|
| 3rd Layer (green-sensitive layer) | Gelatin | 1.30 |
| | Green-sensitive chlorobromide emulsion (Em-G) in terms of the amount of silver | 0.19 |
| | Magenta coupler (M-1) | 0.19 |
| | Magenta coupler (M-2) | 0.19 |
| | Dye image stabilizer (ST-3) | 0.15 |
| | Dye image stabilizer (ST-4) | 0.20 |
| | Dye image stabilizer (ST-5) | 0.15 |
| | DOP | 0.20 |
| | Anti-irradiation dye (AI-1) | 0.01 |
| 2nd Layer (intermediate layer) | Gelatin | 1.15 |
| | Anti-stain agent (HQ-2) | 0.12 |
| | DIDP | 0.15 |
| | Fungicide (F-1) | 0.002 |
| 1st Layer (blue-sensitive layer) | Gelatin | 1.1 |
| | Blue-sensitive chlorobromide emulsion (Em-B) in terms of the amount of silver | 0.26 |
| | Yellow coupler (Y-1) | 0.85 |
| | Dye image stabilizer (ST-1) | 0.30 |
| | Dye image Stabilizer (ST-2) | 0.20 |
| | Anti-stain agent (HQ-1) | 0.02 |
| | Anti-irradiation dye (AI-3) | 0.01 |
| | DNP | 0.19 |
| Support | Polyethylene-coated paper | |

Y-1

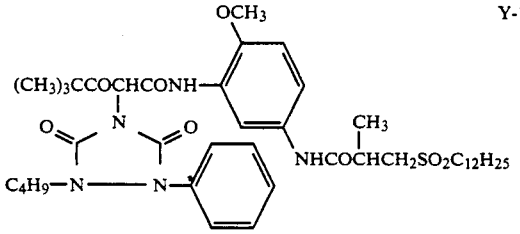

M-1

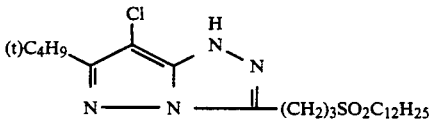

M-2

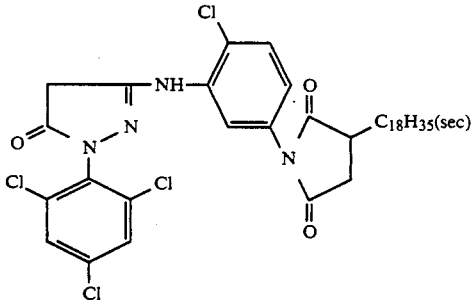

C-1

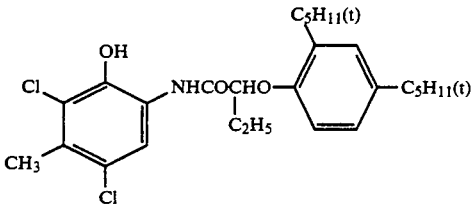

C-2

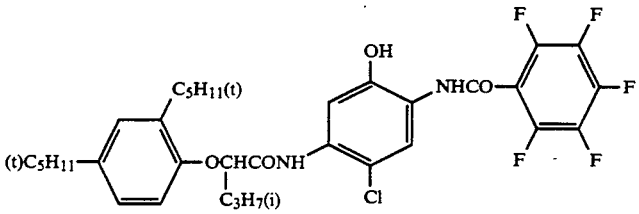

DOP: dioctylphthalate
DIDP: diisodecylphthalate

DNP: dinonylphthalate
PVP: polyvinylpyrrolidone

HQ-1

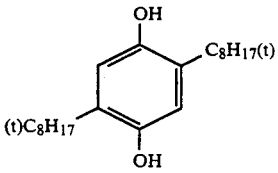

HQ-2

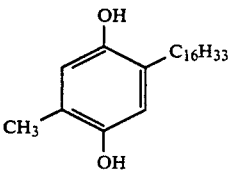

-continued
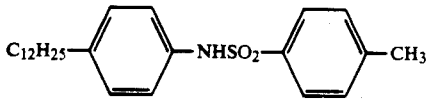
HBS-1
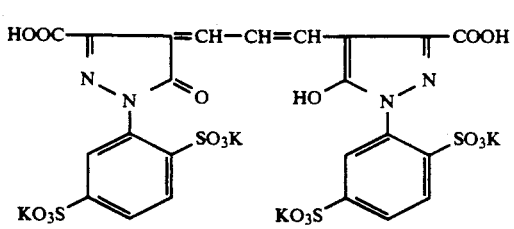
AI-1
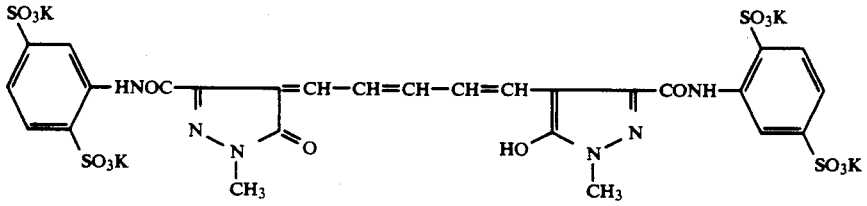
AI-2
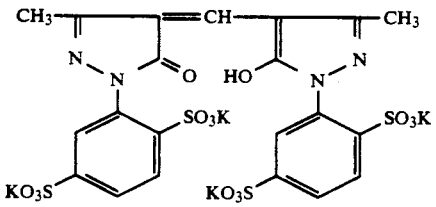
AI-3
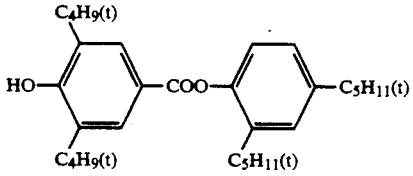
ST-1
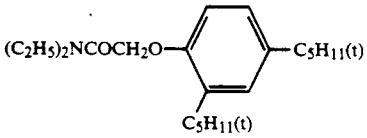
ST-2
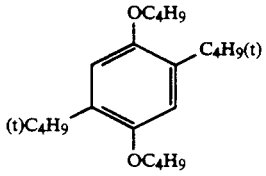
ST-3
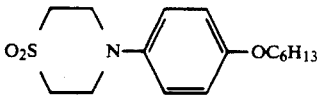
ST-4
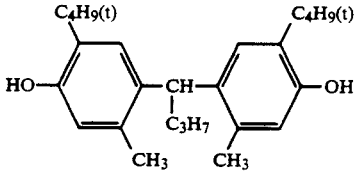
ST-5
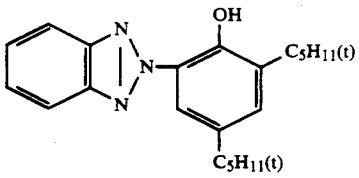
UV-1
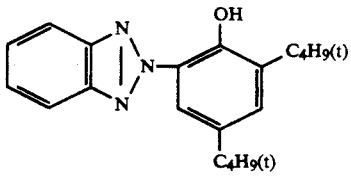
UV-2
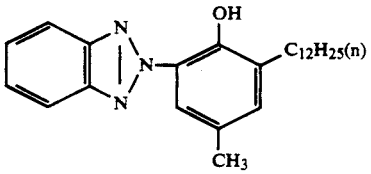
UV-3
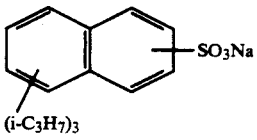
SU-1
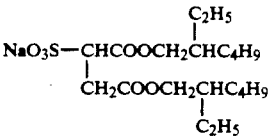
SU-2
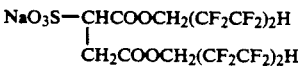
SU-3

$C(CH_2SO_2CH{=}CH_2)_4$ H-1

-continued

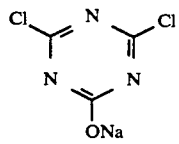

H-2

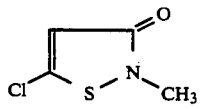

F-1

Preparation of blue-sensitive silver halide emulsion layer

To 1,000 ml of a 2% aqueous gelatin solution that had been heated to 40° C., liquids A and B were added by the double-jet method while controlling pAg and pH at 6.5 and 3.0, respectively. The addition lasted for 30 minutes. Further, liquids C and D were added also by the double-jet method. The addition lasted for 180 minutes, during which pAg and pH were controlled at 7.3 and 5.5, respectively.

pAg was controlled by the method described in Japanese Patent O.P.I Publication No. 45437/1984, and pH was controlled with an aqueous solution of sulfuric acid or sodium hydroxide.

| | |
|---|---|
| (Liquid A) | |
| Sodium chloride | 3.42 g |
| Potassium chloride | 0.03 g |
| Water was added to make the total quantity | 200 ml |
| (Liquid B) | |
| Silver nitrate | 10 g |
| Water was added to make the total quantity | 200 ml |
| (Liquid C) | |
| Sodium chloride | 102.7 g |
| Potassium bromide | 1.0 g |
| Water was added to make the total quantity | 600 ml |
| (Liquid D) | |
| Silver nitrate | 300 g |
| Water was added to make the total quantity | 600 ml |

After the addition, desalting was performed by using a 5% aqueous solution of Demor N (manufactured by Kao Atlas Co., Ltd.) and a 20% aqueous solution of magnesium sulfate. The mixture was then mixed with an aqueous gelatin solution to obtain a monodispersed emulsion (EMP-1) comprising cubic silver halide grains with an average grain size of 0.85 μm, a variation coefficient ($\sigma/r$) of 0.07 and a silver chloride content of 99.5 mol %.

EMP-1 was chemically sensitized with the following compounds. Sensitization was performed at 50° C. for 90 minutes. As a result, a blue-sensitive silver halide emulsion (2Em-B) was obtained.

| | |
|---|---|
| Sodium thiosulfate | 0.8 mg/mol AgX |

-continued

| | |
|---|---|
| Chlorauric acid | 0.5 mg/mol AgX |
| Stabilizer (STAB-1) | $6 \times 10^{-4}$ mol/mol AgX |
| Sensitizing dye (BS-1) | $4 \times 10^{-4}$ mol/mol AgX |
| Sensitizing dye (BS-2) | $1 \times 10^{-4}$ mol/mol AgX |

Preparation of green-sensitive silver halide emulsion

A monodispersed emulsion (EMP-2) comprising cubic silver halide grains with an average grain size of 0.43 μm, a variation coefficient ($\sigma/r$) of 0.08 and a silver chloride content of 99.5 mol % was prepared in substantially the same manner as in the preparation of EMP-1, except that the time spent for the addition of liquids A and B and the time spent for the addition of liquids C and D were varied.

EMP-2 was chemically sensitized with the following compounds. Sensitization was performed at 55° C. for 120 minutes. As a result, a green-sensitive silver halide emulsion (Em-G) was obtained.

| | |
|---|---|
| Sodium thiosulfate | 1.5 mg/mol AgX |
| Chlorauric acid | 1.0 mg/mol AgX |
| Stabilizer (STAB-1) | $6 \times 10^{-4}$ mol/mol AgX |
| Sensitizing dye (GS-1) | $4 \times 10^{-4}$ mol/mol AgX |

Preparation of red-sensitive silver halide emulsion

A monodispersed emulsion (EMP-3) comprising cubic silver halide grains with an average grain si-e of 0.50 μm, a variation coefficient ($\sigma/r$) of 0.08 and a silver chloride content of 99.5 mol % was prepared in substantially the same manner as in the preparation of EMP-1, except that the time spent for the addition of liquids A and B and the time spent for the addition of liquids C and D were varied.

EMP-2 was chemically sensitized with the following compounds. Sensitization was performed at 55° C. for 120 minutes. As a result, a red-sensitive silver halide emulsion (Em-R) was obtained.

| | |
|---|---|
| Sodium thiosulfate | 1.8 mg/mol AgX |
| Chlorauric acid | 2.0 mg/mol AgX |
| Stabilizer (STAB-1) | $8 \times 10^{-4}$ mol/mol AgX |
| Sensitizing dye (RS-1) | $1 \times 10^{-4}$ mol/mol AgX |

BS-1

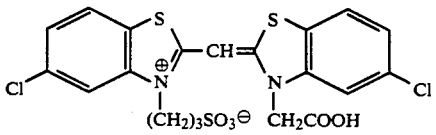

-continued

BS-2

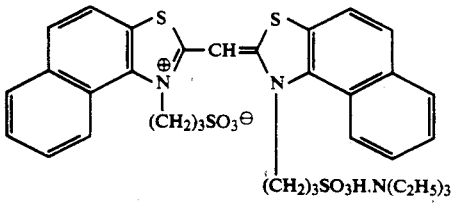

GS-1

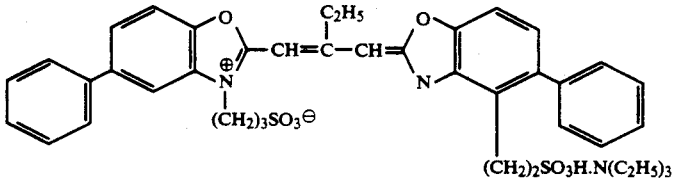

RS-1

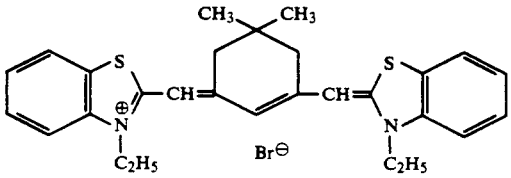

STAB-1

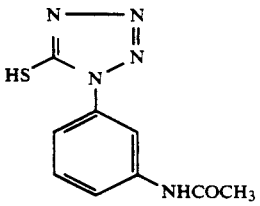

The so-prepared color paper (Sample No. 1) had a silver content of 0.65 g/m$^2$. Test samples were prepared in substantially the same manner as in the preparation of Sample No. 1, except that the silver content was varied as shown in Table 1.

These color paper samples were exposed to light through an optical wedge, followed by processing. Processing procedure and processing conditions were as follows:

| Processing | Temperature | Processing Time | Amount of replenisher (ml/m$^2$) |
|---|---|---|---|
| (1) Color developing | 38° C. | 20 sec | 70 |
| (2) Bleaching | 38° C. | 20 sec | 50 |
| (3) Fixing | 38° C. | 20 sec | 40 |
| (4) Stabilizing* | 30° C. | 1st stabilizing 20 sec | 120 |
| | | 2nd stabilizing 20 sec | |
| (5) Drying | 60 to 80° C. | 30 sec | — |

*Stabilizing was performed by the counter-current system with two stabilizer tanks. The replenisher was supplied to the 2nd stabilizer tank.

(Color developer)

| | |
|---|---|
| Diethylene glycol | 15 g |
| Potassium bromide | 0.03 g |
| Potassium chloride | 2.7 g |
| Potassium sulfite (50% solution) | 0.5 ml |
| Color developing agent (3-methyl-4-amino-N-ethyl-N-(β-methanesulfonamidethyl)-aniline sulfate | 6 g |
| Diethylhydroxylamine | 5 g |
| Triethanolamine | 10 g |
| Potassium carbonate | 30 g |
| Diethylenetriaminepentaacetic acid | 2 g |

-continued

| | |
|---|---|
| Fluorescent brightening agent (compound E-34) | 2 g |
| Water was added to make the total quantity 1l, and pH was adjusted to 10.15 with potassium hydroxide or sulfuric acid. | |

(Color developer replenisher)

| | |
|---|---|
| Diethylene glycol | 17 g |
| Potassium sulfite (50% solution) | 1.0 ml |
| Color developing agent (3-methyl-4-amino-N-ethyl-N-(β-methanesulfonamidethyl)-aniline sulfate | 8.8 g |
| Diethylhydroxylamine | 7 g |
| Triethanolamine | 10 g |
| Potassium carbonate | 40 g |
| Diethylenetriaminepentaacetic acid | 2 g |
| Fluorescent brightening agent (compound E-34) | 2.5 g |
| Water was added to make the total quantity 1l, and pH was adjusted to 10.15 with potassium hydroxide or sulfuric acid. | |

(Bleach)

| | |
|---|---|
| Organic acid ferric complex salt (shown in Table 1) | 0.35 mol |
| Ammonium bromide | 100 g |
| Disodium ethylenediaminetetraacetate | 5 g |
| Organic acid (shown in Table 1) | 0.4 mol |
| Ammonium nitrate | 40 g |
| Water was added to make the total quantity 1l, and pH was adjusted to 4.5 with aqueous ammonia or diluted sulfuric acid. | |

(Bleach replenisher)

| | |
|---|---|
| Organic acid ferric complex salt (shown in Table 1) | 0.40 mol |
| Ammonium bromide | 128 g |
| Disodium ethylenediaminetetraacetate | 8 g |
| Organic acid (shown in Table 1) | 0.5 mol |
| Ammonium nitrate | 50 g |
| Water was added to make the total quantity 1l, and pH was adjusted to 3.2 with aqueous ammonia or | |

-continued

| | |
|---|---|
| diluted sulfuric acid. | |
| (Fixer and fixer replenisher) | |
| Sodium thiosulfate | 100 g |
| Sodium thiocyanate | 100 g |
| Anhydrous sodium bisulfite | 20 g |
| Sodium metabisulfite | 4.0 g |
| Disodium ethylenediaminetetraacetate | 1.0 g |
| Water was added to make the total quantity 1l, and pH was adjusted to 6.5 with glacial acetic acid and aqueous ammonia. | |
| (Stabilier and stabilizer replenisher) | |
| Orthophenyl phenol | 0.15 g |
| $ZnSO_4$ $7H_2O$ | 0.2 g |
| Bismuth chloride | 0.5 g |
| Ammonium sulfite (40% solution) | 5.0 ml |
| 1-hydroxyethylidene-1,1-diphosphonic acid (60% solution) | 3.8 g |
| Ethylenediaminetetraacetic acid | 2.0 g |
| Fluorescent brightening agent | 2.0 g |
| (Tinopal SFP, manufactured by Chiba Geigy) | |
| Water was added to make the total quantity 1l, and pH was adjusted to 7.8 with aqueous ammonia or 50% sulfuric acid. | |

These processing liquids were put in their respective tanks. The above-obtained color paper samples were treated continuously with these liquids, while these liquids were replenished with their respective replenishers by means of a flow pump. Continuous processing was performed until the total amount of the bleach replenisher supplied became three times as large as the capacity of the bleacher tank. After the continuous processing, sludging was examined visually, and evaluated according to the following criterion:

1. no sludging
2. a little sludging
3. considerable sludging 2-1 or 2-3 means a rating between 2 and 1 or 2 and 3.

Further, each of the processed samples was examined for the residual silver amount and the reflectance red density (RDmin) of the unexposed portion.

Odor from the bleacher tank was checked by five monitors, and evaluated according to the following criterion.

a no odor
b: giving out a dim odor
c: giving out an offensive odor
d giving out a very offensive odor The results are shown in Table 1.

TABLE 1

| Experiment No. | Total silver content before processing ($g/m^2$) | Organic acid | Acid Fe salt | Sludging | RDmin | Residual silver amount ($mg/m^2$) | Odor | Remarks |
|---|---|---|---|---|---|---|---|---|
| 1-1 | 2.0 | B-5 | (A-1).Fe | 2-3 | 0.07 | 0.8 | a | Comp. |
| 1-2 | 1.5 | B-5 | (A-1).Fe | 2-3 | 0.05 | 0.6 | a | Comp. |
| 1-3 | 1.0 | B-5 | (A-1).Fe | 2 | 0.03 | 0.2 | a | Inv. |
| 1-4 | 0.8 | B-5 | (A-1).Fe | 1 | 0.03 | 0.1 | a | Inv. |
| 1-5 | 0.7 | B-5 | (A-1).Fe | 1 | 0.02 | 0.1 | a | Inv. |
| 1-6 | 0.65 | B-5 | (A-1).Fe | 1 | 0.02 | 0.1 | a | Inv. |
| 1-7 | 0.5 | B-5 | (A-1).Fe | 1 | 0.02 | 0 | a | Inv. |
| 1-8 | 0.3 | B-5 | (A-1).Fe | 1 | 0.01 | 0 | a | Inv. |
| 1-9 | 0.65 | B-1 | (A-1).Fe | 1 | 0.02 | 0.1 | a | Inv. |
| 1-10 | 0.65 | B-2 | (A-1).Fe | 1 | 0.03 | 0.1 | a | Inv. |
| 1-11 | 0.65 | B-3 | (A-1).Fe | 1 | 0.02 | 0.1 | a | Inv. |
| 1-12 | 0.65 | B-4 | (A-1).Fe | 1 | 0.02 | 0.1 | a | Inv. |
| 1-13 | 0.65 | B-5 | (A-1).Fe | 1 | 0.02 | 0.1 | a | Inv. |
| 1-14 | 0.65 | B-6 | (A-1).Fe | 1 | 0.03 | 0.2 | a | Inv. |
| 1-15 | 0.65 | B-7 | (A-1).Fe | 1 | 0.03 | 0.1 | a | Inv. |
| 1-16 | 0.65 | B-8 | (A-1).Fe | 2-1 | 0.03 | 0.2 | a | Inv. |
| 1-17 | 0.65 | B-16 | (A-1).Fe | 2 | 0.01 | 0 | a | Inv. |
| 1-18 | 0.65 | Acetic acid | (A-1).Fe | 3 | 0.03 | 0.2 | d | Comp. |
| 1-19 | 0.65 | Propionic acid | (A-1).Fe | 3 | 0.05 | 1.0 | c | Comp. |
| 1-20 | 0.65 | Formic acid | (A-1).Fe | 3 | 0.04 | 1.2 | c | Comp. |
| 1-21 | 0.65 | 3-Hydroxypropionic acid | (A-1).Fe | 3 | 0.04 | 0.9 | c | Comp. |
| 1-22 | 0.65 | Acrylic acid | (A-1).Fe | 3 | 0.05 | 0.8 | c | Comp. |
| 1-23 | 0.65 | Lactic acid | (A-1).Fe | 3 | 0.03 | 1.0 | b | Comp. |
| 1-24 | 0.65 | Glycolic acid | (A-1).Fe | 3 | 0.05 | 0.9 | a | Comp. |
| 1-25 | 0.65 | B-5 | (A-4).Fe | 1 | 0.01 | 0 | a | Inv. |
| 1-26 | 0.65 | B-5 | (A-5).Fe | 1 | 0.01 | 0 | a | Inv. |
| 1-27 | 0.65 | B-5 | (A-9).Fe | 1 | 0.02 | 0 | a | Inv. |
| 1-28 | 0.65 | B-5 | EDTA.Fe | 1 | 0.03 | 0.9 | a | Comp. |
| 1-29 | 0.65 | B-5 | NTA.Fe | 2-1 | 0.03 | 1.2 | a | Comp. |
| 1-30 | 0.65 | B-5 | CyDTA.Fe | 2-1 | 0.02 | 1.1 | a | Comp. |
| 1-31 | 0.65 | B-5 | EDTMP.Fe | 2-1 | 0.03 | 1.0 | a | Comp. |

(Abbreviations in Table 1)
EDTA Fe: Ferric ammonium ethylenediaminetetraacetate
NTA Fe: Ferric ammonium nitrilotriacetate
CyDTA Fe: Ferric ammonium 1,2-cyclohexanediaminetetraacetate
EDTMP Fe: Ferric ammonium ethylenediaminetetramethylene phosphate
(A-1).Fe: Ferric ammonium salt of A-1
(A-4).Fe: Ferric ammonium salt of A-4
(A-5).Fe: Ferric ammonium salt of A-5
(A-9).Fe: Ferric ammonium salt of A-9

As is evident from Table 1, good results were obtained as to sludging, fogging of the unexposed portion, desilvering and the odor of bleacher, only when a light-sensitive material with a total silver content of 1 $g/m^2$ or less before processing was treated in a bleacher that contained an organic acid and a specific ferric complex salt of an organic acid (the compounds represented by the Formula [A] or [B]).

EXAMPLE 2

A series of experiments were conducted in substantially the same manner as in Example 1, except that the pH (after the completion of the continuous processing)

of the bleacher employed in the experiment Nos. 1 to 6 was varied to those shown in Table 2. The results are shown in Table 2.

TABLE 2

| Experiment No. | pH of bleach | Sludging | RDmin | Residual silver amount |
|---|---|---|---|---|
| 2-1 | 2.0 | 2 | 0.04 | 0 |
| 2-2 | 2.5 | 1 | 0.03 | 0.1 |
| 2-3 | 3.0 | 1 | 0.02 | 0.1 |
| 2-4 | 4.0 | 1 | 0.02 | 0.1 |
| 2-5 | 5.0 | 1 | 0.02 | 0.1 |
| 2-6 | 5.5 | 2-1 | 0.04 | 0.3 |
| 2-7 | 6.0 | 2 | 0.06 | 0.5 |
| 2-8 | 7.0 | 2 | 0.08 | 0.7 |

In the table, 1, 2 and 2-1 each have the same meaning as those in Table 1.

The results shown in Table 2 reveal that good results were obtained for sludging, fogging of the unexposed portion and desilvering, when the bleacher had a pH of 2.5 to 5.5 after the completion of the continuous processing. Better results were obtained when the pH was in the range of 3.0 to 5.0.

EXAMPLE 3

A series of experiments were conducted in substantially the same manner as in Example 1, except that the silver chloride contents of the emulsion layers of the color paper samples employed in the experiment Nos. 1 to 6 were varied to those shown in Table 3, and that the evaluation was made for the reflectance blue density (BDmax) of the highest density portion and the residual silver content. The results obtained are summarized in Table 3.

TABLE 3

| Experiment No. | Silver chloride content (mol %) | Residual silver content ($mg/dm^2$) | BDmax |
|---|---|---|---|
| 3-1 | 30 | 2.6 | 1.13 |
| 3-2 | 40 | 1.7 | 1.36 |
| 3-3 | 50 | 0.8 | 1.65 |
| 3-4 | 65 | 0.7 | 1.73 |
| 3-5 | 80 | 0.4 | 1.83 |
| 3-6 | 90 | 0.3 | 1.98 |
| 3-7 | 95 | 0.2 | 2.18 |
| 3-8 | 98 | 0.1 | 2.27 |
| 3-9 | 99 | 0.1 | 2.30 |
| 3-10 | 99.5 | 0.1 | 2.31 |

As is apparent from Table 3, the objects of the invention were attained satisfactorily when the silver chloride content of the emulsion layer of a light-sensitive material to be processed by the method of the invention was 50 mol % or more. Better results were obtained when this content was 90 mol % or more. Far better results were obtained when this content was 95% mol % or more, and the best results were obtained when this content was 98 mol % or more. Example 4

A series of experiments were conducted in substantially the same manner as in Example 1 or 3, except that the kind of preservative was varied from diethylhydroxylamine (employed in the experiment Nos. 1 to 6) to those shown in Table 4. The amount of the preservative (in terms of the number of mols) was the same as that in Example 1 or 3.

The results obtained are shown in Table 4.

TABLE 4

| Experiment No. | Preservative | Sludging | BDmax | RDmin |
|---|---|---|---|---|
| 4-1 | Diethylhydroxylamine | 1 | 2.31 | 0.02 |
| 4-2 | Not added | 3 | 1.39 | 0.06 |
| 4-3 | Hydroxylamine sulfate | 1 | 1.03 | 0.02 |
| 4-4 | (A'-2) | 1 | 2.30 | 0.01 |
| 4-5 | (A'-10) | 1 | 2.32 | 0.01 |
| 4-6 | (A'-13) | 1 | 2.33 | 0.01 |
| 4-7 | (A'-18) | 1 | 2.31 | 0.01 |
| 4-8 | (A'-21) | 1 | 2.30 | 0.02 |
| 4-9 | (B-5) | 1 | 2.31 | 0.02 |
| 4-10 | (B-19) | 1 | 2.30 | 0.03 |
| 4-11 | (B-20) | 1 | 2.29 | 0.03 |

The results shown in Table 4 reveal that the objects of the invention could be attained successfully when the color developer contained the compound represented by the Formula [A'] or [B'].

EXAMPLE 5

A series of experiments were conducted in substantially the same manner as in Example 1, except that the kind of cyan coupler was varied from C-1 to those represented by PC-I (C-4, 11, 15, 19, 20) and those represented by PC-II (PC-II-2, 8, 24, 26, 27, 28, 31 and 32).

The results obtained demonstrate that, by the use of these cyan couplers, the reflectance red density of the unexposed portion was reduced by 25 to 30% and the residual silver amount was decreased by 15 to 25%.

What is claimed is:

1. A method for processing a silver halide color photographic light-sensitive material comprising a support having thereon a silver halide emulsion layer, comprising steps of developing said light-sensitive material with a color developer bleaching, after said developing step, said light-sensitive material with a bleaching solution, and treating, after said bleaching step, said light-sensitive material with a solution having fixing capability, wherein said light-sensitive material has a coating weight of silver of not more than 1 $g/m^2$;

said silver halide emulsion layer contains silver halide grains having silver chloride content of not less than 80 mol %; and said bleaching solution comprises at least one of ferric complex salts of compounds represented by the following formula (A) and at least one of compounds represented by the following formula (B):

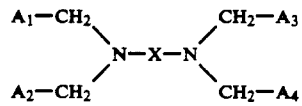

Formula (A)

wherein $A_1$ through $A_4$ each represent $—CH_2OH$, —COOM or $—PO_3M_1M_2$, which may be the same with or different from each other; M, $M_1$ and $M_2$ each represent a hydrogen atom, a sodium atom, a potassium atom or ammonium group; and X represents a branched or unbranched alkylene group having 3 to 6 carbon atoms, $A\leftarrow COOM)_n$. Formula (B)

wherein A represents a single bond or divalent group when n is 2, and a trivalent group when n is 3; M represents a hydrogen atom, an alkali metal or an ammonium group, and M may be either identical or different, the compounds of formula (A) are used in an amount at least from 0.10 mol/l and the compounds of formula (B) are used in an amount from 0.05 to 2.0 mol/l of said bleacher.

2. A method of claim 1, wherein said bleaching solution contains said ferric complex salt in amount of 0.15 to 0.6 mol per liter of said bleaching solution.

3. A method of claim 1, wherein said bleaching solution has a pH value of 2.0 to 5.5.

4. A method of claim 1, wherein the coating weight of silver of said light-sensitive material is within a range of 0.1 to 0.8 g/m$^2$.

5. A method of claim 1, wherein said silver halide emulsion layer contains silver halide grains having a silver chloride content of not less than 90 mol %.

6. A method of claim 1, wherein said color developer comprises a compound represented by the following formula (A'). or (B'):

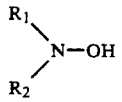

wherein $R_1$ and $R_2$ each represent a hydrogen atom, an alkyl group, an aryl group or R'—CO—, and may combine with each other to form a ring, provided that $R_1$ and $R_2$ cannot be hydrogen atoms simultaneously; and R' represents an alkoxy, alkyl or aryl group,

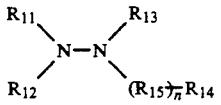

wherein $R_{11}$, $R_{12}$, and $R_{13}$ each represent a hydrogen atom, an alkyl group, an aryl group or a heterocyclic group; $R_{14}$ represents hydroxy, hydroxyamino, an alkyl or aryl group, a heterocyclic group, an alkoxy, aryloxy, carbamoyl or amino group, and $R_{13}$ and $R_{14}$ may combine to form a ring; $R_{15}$ represents a divalent group selected from —CO—, —$SO_2$— and

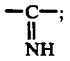

and n is an integer of 0 or 1.

7. A method of claim 6, wherein said compound is represented by the formula (A') or (B') contained in an amount of 2 to 30 g per liter of said developer.

8. A method of claim 1, wherein said color developer comprises a fluorescent brightening agent represented by formula (E):

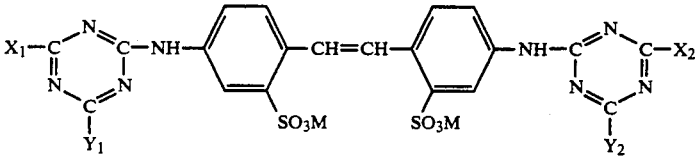

wherein $X_1$, $X_2$ and $Y_1$ and $Y_2$ each represent a hydroxy qroup, a halogen atom, an alkyl or aryl group,

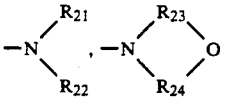

or —$OR_{25}$, wherein $R_{21}$ and $R_{22}$ each represent a hydrogen atom, an alkyl or aryl group; $R_{23}$ and $R_{24}$ each represent an alkyene group; $R_{25}$ represent a hydroqen atom, an alkyl or aryl group; and M represents a cation.

9. A method of claim 1, wherein said bleaching is performed immediately after said developing step.

* * * * *

UNITED STATES PATENT AND TRADEMARK OFFICE

CERTIFICATE OF CORRECTION

PATENT NO. : 5,236,814
DATED : August 17, 1993
INVENTOR(S) : Satoru Kuse et al.

It is certified that error appears in the above-indentified patent and that said Letters Patent is hereby corrected as shown below:

Claim 6, column 67, line 22, after (A') delete --.--.

Claim 6, column 67, line 23, insert "Formula (A')".

Claim 6, column 68, line 1, insert "Formula (B')".

Claim 8, column 68, line 26, insert, "Formula (E)"

Claim 8, column 68, line 44, change "alkyene" to --alkylene--.

Claim 8, column 68, line 44, change "hydroqen" to --hydrogen--.

Signed and Sealed this

Twenty-eighth Day of June, 1994

Bruce Lehman

*Attest:*

BRUCE LEHMAN

*Attesting Officer*

*Commissioner of Patents and Trademarks*